US010118106B2

(12) United States Patent
Couch

(10) Patent No.: US 10,118,106 B2
(45) Date of Patent: Nov. 6, 2018

(54) INTERACTIVE TOY AND METHOD OF USE

(71) Applicant: Charles Vincent Couch, Bellaire, TX (US)

(72) Inventor: Charles Vincent Couch, Bellaire, TX (US)

( * ) Notice: Subject to any disclaimer, the term of this patent is extended or adjusted under 35 U.S.C. 154(b) by 52 days.

(21) Appl. No.: 14/791,385

(22) Filed: Jul. 3, 2015

(65) Prior Publication Data

US 2017/0001125 A1 Jan. 5, 2017

(51) Int. Cl.
*A63H 33/26* (2006.01)
*A63H 3/28* (2006.01)

(52) U.S. Cl.
CPC ..... *A63H 33/26* (2013.01); *A63H 3/28* (2013.01); *A63H 2200/00* (2013.01)

(58) Field of Classification Search
CPC .... A63H 33/00; A63H 2200/00; A63H 33/26; A63J 21/00
See application file for complete search history.

(56) References Cited

U.S. PATENT DOCUMENTS 5,679,049 A 10/1997 Arad et al.
6,659,835 B1 12/2003 Allen
6,773,344 B1 * 8/2004 Gabai ..... A63H 3/28 463/1
7,878,905 B2 2/2011 Weston et al.
7,896,742 B2 3/2011 Weston et al.
8,942,637 B2 * 1/2015 Roach ..... H04B 7/26 455/344
9,039,533 B2 * 5/2015 Barney ..... A63H 30/04 463/36
2002/0058459 A1 * 5/2002 Holt ..... A63H 33/00 446/484
2002/0090985 A1 * 7/2002 Tochner ..... A63F 13/12 463/1
2003/0198927 A1 * 10/2003 Campbell ..... A63H 11/00 434/307 R
2005/0153661 A1 * 7/2005 Beck ..... H04B 1/385 455/73
2007/0259594 A1 * 11/2007 Galbiati ..... A63H 5/00 446/15
2010/0076597 A1 * 3/2010 Wang ..... A63H 3/28 700/245
2010/0093434 A1 * 4/2010 Rivas ..... A63F 13/12 463/35
2011/0081820 A1 4/2011 Faecher
2012/0295510 A1 11/2012 Boeckle

* cited by examiner

*Primary Examiner* — Gene Kim
*Assistant Examiner* — Alyssa Hylinski
(74) *Attorney, Agent, or Firm* — Shannon L Warren

(57) ABSTRACT

An interactive toy system comprising an outer body, a one or more buttons, an integrated circuit, a battery, a speaker, and a microphone. Said integrated circuit comprising a one or more processors, and a memory. Said memory of said integrated circuit configured to store a one or more outgoing messages comprising a first outgoing message. Said interactive toy is configured to playback said first outgoing message after said first input. Said one or more outgoing messages are associated with a grant flag comprising a true or false value. Said interactive toy is configured to set a wishing mode flag to match said grant flag from said first outgoing message. Said interactive toy is configured to record and store a one or more incoming messages, comprising a first incoming message, after said wishing mode is set to true.

16 Claims, 32 Drawing Sheets

1100

| Button Description 1102 | Short Description | Single Click Action 1104 | Double Click Action 1106 | Triple Click Action 1108 | Hold Button Action 1110 |
|---|---|---|---|---|---|
| first button 602a | Power | Power On/Off Alternate | N/A | N/A | N/A |
| second button 602b | Outgoing | wish granting procedure 1400 | N/A | N/A | activate-deactivate LEDs 1900 |
| third button 602c | Parent UI | playback wishes 1700 | record new messages dialog 1800 | set wishing mode 1500 | activate pairing mode 2000 |

FIG. 11A

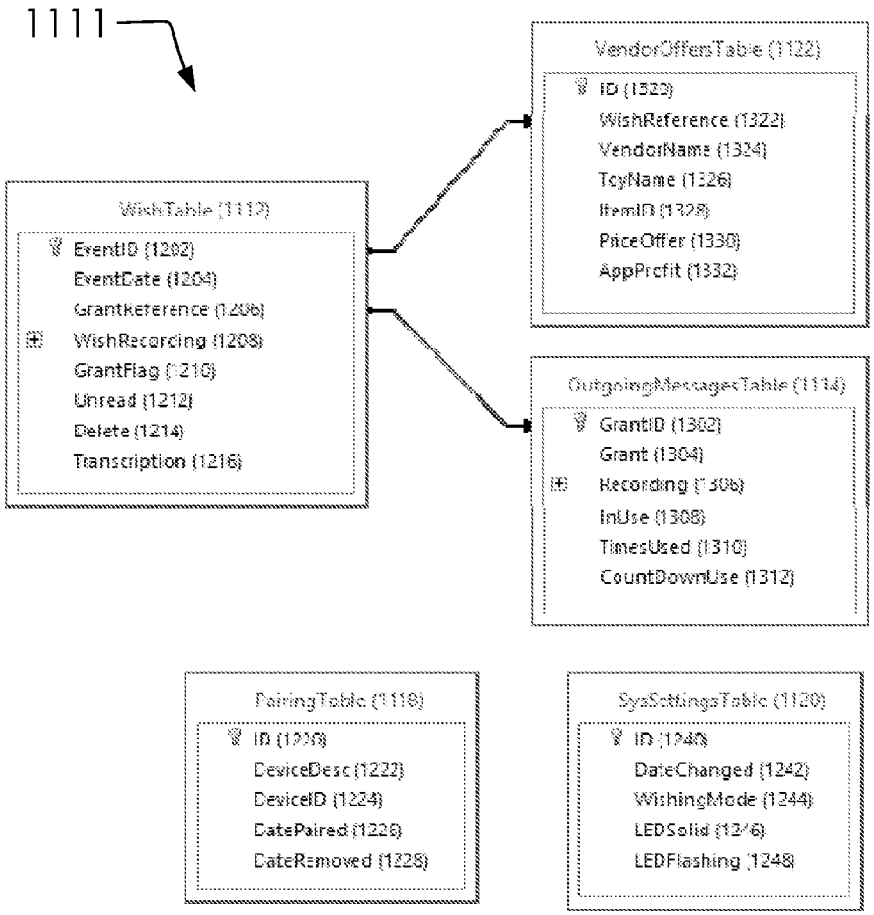

FIG. 11B

1112

| EventID (1202) | EventDate (1204) | GrantReference (1206) | WishRecording (1208) | GrantFlag (1210) | Unread (1212) | Delete (1214) | Transcription (1216) |
|---|---|---|---|---|---|---|---|
| 1 | 6/21/15 17:16 | 1 | 1 | Yes | Yes | No | I want a new bike |
| 2 | 6/22/15 19:16 | 2 | 1 | Yes | Yes | No | I want to go see the new princess movie with daddy |
| 3 | 6/23/15 20:16 | 7 | 0 | No | Yes | No | |
| 4 | 6/24/15 17:16 | 11 | 0 | No | Yes | No | |
| 5 | 6/26/15 17:16 | 7 | 0 | No | No | No | |
| 6 | 6/27/15 17:16 | 16 | 0 | No | No | No | |
| 7 | 6/28/15 17:20 | 8 | 1 | Yes | No | No | [Transcription] |

FIG. 12A

1118

| ID (1220) | DeviceDesc (1222) | DeviceID (1224) | DatePaired (1226) | DateRemoved (1228) |
|---|---|---|---|---|
| 1 | [First Device Description] | [Device ID] | 6/9/15 0:23 | |
| 2 | [Second Device Description] | [Device ID] | 6/22/15 8:24 | |

FIG. 12B

1120

| ID (1240) | DateChanged (1242) | WishingMode (1244) | LEDSolid (1246) | LEDFlashing (1248) |
|---|---|---|---|---|
| 18 | 06/30/15 0:00 | Yes | No | No |

FIG. 12C

1114

| GrantID (1302) | Grant (1304) | Recording (1306) | InUse (1308) | TimesUsed (1310) | CountDownUse (1312) |
|---|---|---|---|---|---|
| 1 | Yes | 1 | Yes | 1 | 16 |
| 2 | No | 1 | Yes | 1 | 15 |
| 3 | No | 1 | Yes | | 1 |
| 4 | No | 1 | Yes | | 8 |
| 5 | No | 1 | Yes | | 2 |
| 6 | No | 1 | Yes | | 3 |
| 7 | No | 1 | Yes | 2 | 10 |
| 8 | Yes | 1 | Yes | | 13 |
| 9 | No | 1 | Yes | | 6 |
| 10 | No | 1 | Yes | | 4 |
| 11 | No | 1 | Yes | 1 | 12 |
| 12 | No | 1 | Yes | | 7 |
| 13 | No | 1 | Yes | | 5 |
| 14 | No | 1 | Yes | | 14 |
| 15 | No | 1 | Yes | | 11 |
| 16 | Yes | 1 | Yes | 1 | 9 |

FIG. 13A

1122

| ID (1320) | WishReference (1322) | VendorName (1324) | ToyName (1326) | ItemID (1328) | PriceOffer (1330) | AppProfit (1332) |
|---|---|---|---|---|---|---|
| 1 | 1 | Fist Vendor | First Bike | [Vendor Item ID] | $10.00 | $0.20 |
| 2 | 1 | Second Vendor | First Bike | [Vendor Item ID] | $11.00 | $0.19 |
| 3 | 1 | First Vendor | Second Bike | [Vendor Item ID] | $9.00 | $0.11 |
| 4 | 2 | First theater | 10% off coupon for movie tickets | [Vendor Item ID] | $0.00 | $0.30 |
| 5 | 2 | Second theater | 10% off coupon for movie tickets | [Vendor Item ID] | $0.00 | $0.33 |

FIG. 13B

Device Application (502)

Wish Tab (2202) | Outgoing Messages Tab (2204) | Pairing Tab (2206) | System Settings Tab (2208) | Wish Offers Tab (2210)

Wish Tab (2202)

| EventID (1202) | EventDate (1204) | WishRecording (1208) | GrantFlag (1210) | Recording (1306) | Unread (1212) | Transcription (1216) |
|---|---|---|---|---|---|---|
| 7 | 06/28/15 5:20:28 PM | | ☑ | | ☐ | [Transcription] |
| 6 | 06/27/15 5:16:51 PM | | ☐ | | ☐ | |
| 5 | 06/26/15 5:16:49 PM | | ☐ | | ☐ | |
| 4 | 06/24/15 5:16:48 PM | | ☐ | | ☑ | |
| 3 | 06/23/15 8:16:46 PM | | ☐ | | ☑ | |
| 2 | 06/22/15 7:16:45 PM | | ☑ | | ☑ | I want to go see the new princess movie with daddy |
| 1 | 06/21/15 5:16:27 PM | | ☑ | | ☑ | I want a new bike |

Share 2214

Delete 2216

View Offers 2218

FIG. 22

Device Application (502)

Wish Tab (2202) | Outgoing Messages Tab (2204) | Pairing Tab (2206) | System Settings Tab (2208) | Wish Offers Tab (2210)

Pairing Tab (2206)

| ID (1220) | DeviceDesc (1222) | DeviceID (1224) | DatePaired (1226) | DateRemoved (1228) |
|---|---|---|---|---|
| 1 | [First Device Description] | [Device ID] | 06/09/15 12:23:45 AM | |
| 2 | [Second Device Description] | [Device ID] | 06/22/15 8:24:00 AM | |

Unpair 2400

Pair New Device 2402

FIG. 24

Device Application (502)

Wish Tab (2202) | Outgoing Messages Tab (2204) | Pairing Tab (2206) | System Settings Tab (2208) | Wish Offers Tab (2210)

System Settings Tab (2208)

| ID (1240) | DateChanged (1242) | WishingMode (1244) | LEDSolid (1246) | LEDFlashing (1248) |
|---|---|---|---|---|
| 18 | 06/30/15 | ☑ | ☐ | ☐ |

FIG. 25

Device Application (502)

Wish Tab (2202) | Outgoing Messages Tab (2204) | Pairing Tab (2206) | System Settings Tab (2208) | Wish Offers Tab (2210)

Wish Offers Tab (2210)

EventID (1202): 1

EventDate (1204): 06/21/15 5:16:27 PM

GrantReference (1206): 1

WishRecording (1208):

GrantFlag (1210): ☑

Recording (1306):

Unread (1212): ☑

Transcription (1216): I want a new bike

| ID (1320) | WishReference (1322) | VendorName (1324) | ToyName (1326) | ItemID (1328) | PriceOffer (1330) |
|---|---|---|---|---|---|
| 1 | 1 | First Vendor | First Bike | [Vendor Item ID] | $10.00 |
| 2 | 1 | Second Vendor | First Bike | [Vendor Item ID] | $11.00 |
| 3 | 1 | First Vendor | Second Bike | [Vendor Item ID] | $9.00 |

2604

Order Item 2602

FIG. 26

INTERACTIVE TOY AND METHOD OF USE

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to an interactive toy and method of use. Examples of an interactive toy can be found at US20070259594 A1, U.S. Ser. No. 10/954,025, US 20110081820 A1, U.S. Pat. No. 7,896,742 B2, U.S. Pat. No. 7,878,905 B2, U.S. Pat. No. 5,679,049 A, U.S. Pat. No. 6,659,835 B1, and US 20120295510 A1.

None of the above inventions and patents, taken either singularly or in combination, is seen to describe the instant disclosure as claimed. Accordingly, an interactive toy and method of use would be advantageous.

BRIEF SUMMARY OF THE INVENTION

An interactive toy system comprising an outer body, a one or more buttons, an integrated circuit, a battery, a speaker, and a microphone. Said one or more buttons, said battery, said speaker and said microphone are wired into said integrated circuit. Said integrated circuit comprising a one or more processors, and a memory. Said memory of said integrated circuit configured to store a one or more outgoing messages comprising a first outgoing message. Said one or more buttons configured to receive a one or more user inputs comprising a first input from. Said interactive toy is configured to playback said first outgoing message after said first input. Said one or more outgoing messages are associated with a grant flag comprising a true or false value. Said interactive toy is configured to set a wishing mode flag to match said grant flag from said first outgoing message. Said interactive toy is configured to record and store a one or more incoming messages, comprising a first incoming message, after said wishing mode is set to true.

A method of using an interactive toy, the method comprising playing a one or more outgoing messages on said interactive toy where said one or more outgoing messages are from a first user each is associated with a grant flag, recording a one or more incoming messages from a second user when said grant flag is set to true on said interactive toy, and transmitting a portion of said one or more incoming and said one or more outgoing messages to said first user. Said interactive toy comprises an outer body, a one or more buttons, an integrated circuit, a battery, a speaker, and a microphone. Said one or more buttons, said battery, said speaker and said microphone are wired into said integrated circuit. Said integrated circuit comprising a one or more processors, and a memory. Said memory of said integrated circuit configured to store a one or more outgoing messages comprising a first outgoing message. Said one or more buttons configured to receive a one or more user inputs comprising a first input from. Said interactive toy is configured to playback said first outgoing message after said first input. Said one or more outgoing messages are associated with a grant flag comprising a true or false value. Said interactive toy is configured to set a wishing mode flag to match said grant flag from said first outgoing message. Said interactive toy is configured to record and store a one or more incoming messages, comprising a first incoming message, after said wishing mode is set to true.

BRIEF DESCRIPTION OF THE SEVERAL VIEWS OF THE DRAWING

FIG. 11A illustrates a view of a button press to action table 1100.

FIG. 11B illustrates a view of a data relationship diagram 1111.

FIG. 12A illustrates a view of a WishTable 1112.

FIG. 12B illustrates a view of a PairingTable 1118.

FIG. 12C illustrates a view of a SysSettingsTable 1120.

FIG. 13A illustrates a view of said OutgoingMessagesTable 1114.

FIG. 13B illustrates a view of said VendorOffersTable 1122.

FIGS. 22-26 introduce and illustrate parts of said device application 502.

FIG. 22 illustrates a view of said device application 502 featuring a WishTab 2202.

FIG. 23 illustrates a view of said device application 502 featuring said OutgoingMessagesTab 2204.

FIG. 24 illustrates a view of said device application 502 featuring said PairingTab 2206.

FIG. 25 illustrates a view of said device application 502 featuring said SystemSettingsTab 2208.

FIG. 26 illustrates a view of said device application 502 featuring said WishOffersTab 2210.

DETAILED DESCRIPTION OF THE INVENTION

Described herein is an interactive toy and method of use. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
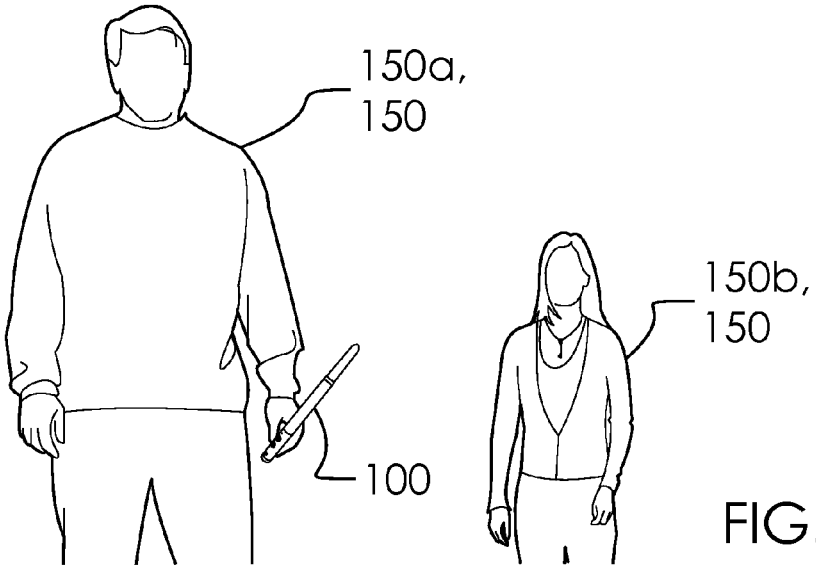
FIG. 1A illustrates a diagram of a first user 150*a* using an interactive toy 100 with a second user 150*b*.

FIG. 1A illustrates a diagram of a first user 150*a* using an interactive toy 100 with a second user 150*b*.

In one embodiment, said interactive toy 100 can be used by a plurality of users 150 which can comprise said first user 150*a* and said second user 150*b*. For purposes of this discussion, in one embodiment, said first user 150*a* can comprise a parent and said second user 150*b* can comprise a child; wherein, said interactive toy 100 can be used as a tool to facilitate constructive parenting by said first user 150*a*.

Said interactive toy 100 can be given to a child by a parent as a reward for good behavior and/or an incentive for positive past performance. Likewise, said interactive toy 100 can be used as an incentive for future good behavior.

Once in the possession of a child (such as said second user 150*b*), said interactive toy 100 can be used to encourage frank feedback from said child on topics of the parent's choosing, with the occasional opportunity to request tokens or objects from the parent (or, "wishes"). Parents (such as said first user 150*a*) can have the option of encouraging the child to believe that said interactive toy 100 is magical in that said second user 150*b* is lead to believe that messages recorded on said interactive toy 100 have magical influence on the behavior of said first user 150*a*. In reality, said interactive toy 100 can be a device capable of capturing messages from a user (such as said second user 150*b*), to organize those messages, and delivering/transmitting those messages to another user (such as parent, like said first user 150*a*).

For marketing purposes, said interactive toy 100 can be described as a "wishing wand" and its magical powers known as the "power of the wand". The structural distinctiveness is described in the following disclosure and method of using said interactive toy 100 are, likewise, disclosed. Further, for marketing purposes, said interactive toy 100 can be said to be the "wishing wand that works".

Note that, despite the marketing approach used by the Applicants, said interactive toy 100 can be wrapped in a different form factor and maintain the same functionality. Accordingly, one exemplary embodiment is included in FIGS. 26A-26B, where aspects of said interactive toy 100 are marketed in a stuff toy animal.

Likewise, said interactive toy 100 has uses for sets of people having different relationships than that of parent-child, as would be obvious to one of skill in the art. Examples of other relationships can comprise teacher-student, marketer-audience, etc.

Figure 1B:
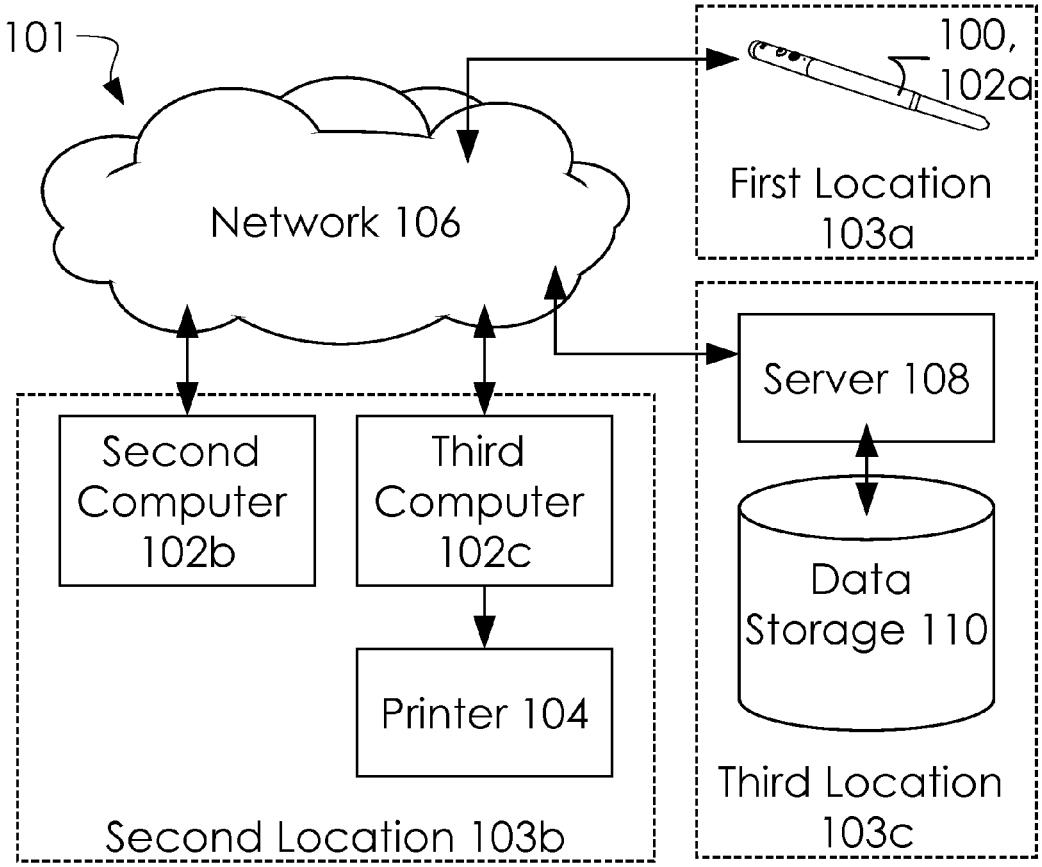
FIG. 1B illustrates a first network configuration 101. In one embodiment, said first network configuration 101 can comprise a one or more computers 102 at a one or more locations 103.

FIG. 1B illustrates a first network configuration 101. In one embodiment, said first network configuration 101 can comprise a one or more computers 102 at a one or more locations 103.

In one embodiment, said one or more computers 102 can comprise a first computer 102*a*, a second computer 102*b* and a third computer 102*c*. In one embodiment, said one or more locations 103 can comprise a first location 103*a*, a second location 103*b* and a third location 103*c*. In one embodiment, said one or more computers 102 can communicate on a network 106, which can connect to a one or more servers (such as a server 108). In one embodiment, a printer 104 can be hardwired to said first computer 102*a* (not illustrated here), or said printer 104 can connect to one of said one or more computers 102 (such as said third computer 102*c*, illustrated) via network 106.

Said network 106 can be a local area network (LAN), a wide area network (WAN), a piconet, or a combination of LANs, WANs, or piconets. One illustrative LAN is a network within a single business. One illustrative WAN is the Internet, as is known in the art.

In one embodiment, said server 108 represents at least one, but can be many servers, each connected to one another or to said network 106. Said server 108 can connect to a data storage 110. Said data storage 110 can connect directly to said server 108, as shown in FIG. 1, or may exist remotely on said network 106. In one embodiment, said data storage 110 can comprise any suitable long-term or persistent storage device and, further, may be separate devices or the same device and may be collocated or distributed (interconnected via any suitable communications network).

Figure 2A:
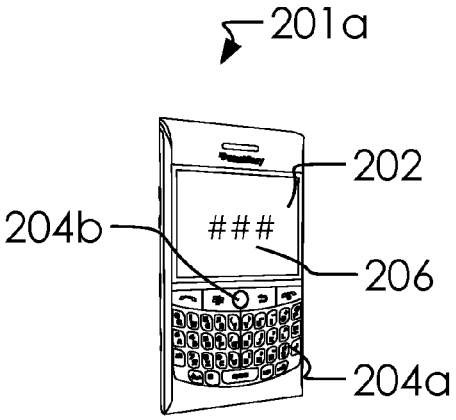
FIGS. 2A, 2B and 2C illustrate a perspective overview of a mobile phone 201*a*, a personal computer 201*b* and a tablet 201*c*.
Figure 2B:
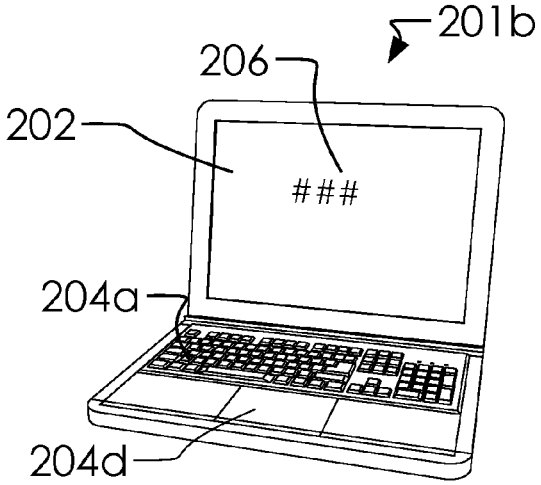
Figure 2C:
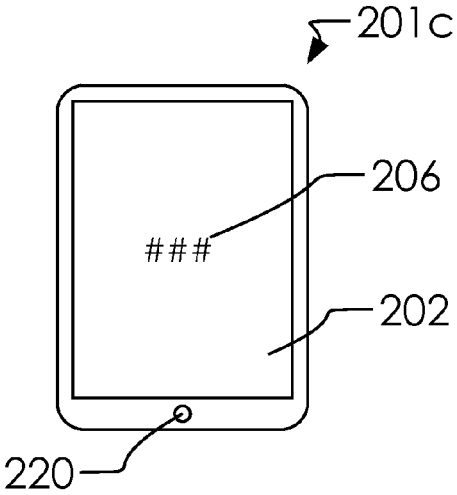
Figure 3A:
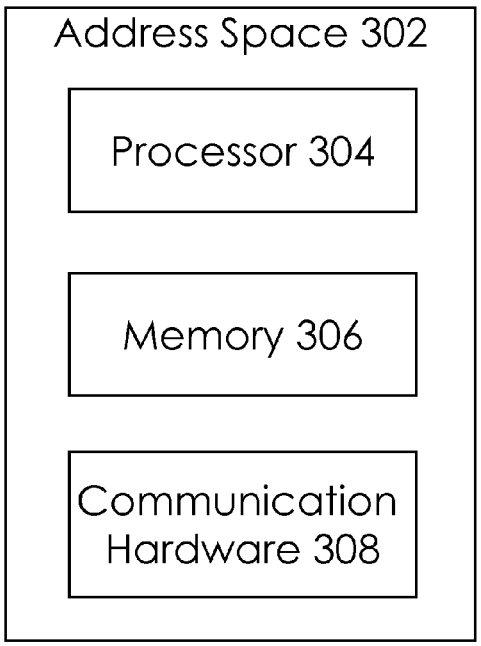
FIGS. 3A, 3B, 3C and 3D illustrate an address space 302 within said one or more computers 102, an address space 302*a*, an address space 302*b* and an address space 302*d*.
Figure 3B:
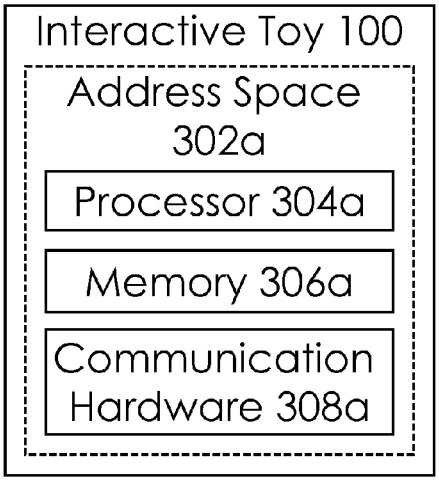
Figure 3C:
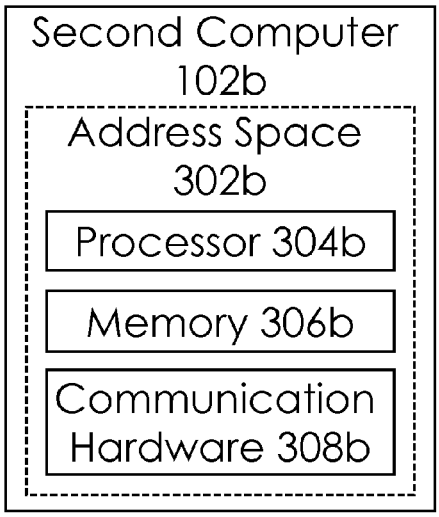
Figure 3D:
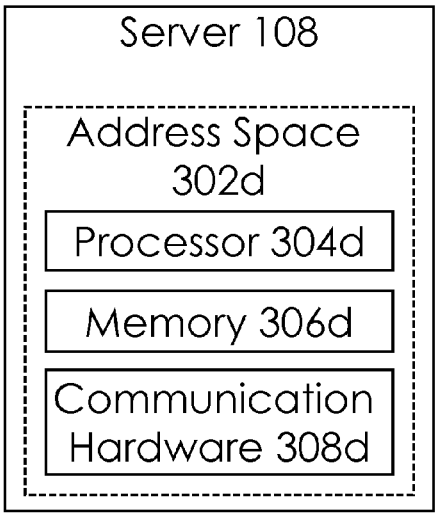

FIGS. 2A, 2B and 2C illustrate a perspective overview of a mobile phone 201*a*, a personal computer 201*b* and a tablet 201*c*.

In the last several years, the useful definition of a computer has become more broadly understood to include mobile phones, tablet computers, laptops, desktops, and similar. For example, Microsoft®, have attempted to merge devices such as a tablet computer and a laptop computer with the release of "Windows® 8". In one embodiment, said one or more computers 102 each can include, but is not limited to, a laptop (such as said personal computer 201*b*), desktop, workstation, server, mainframe, terminal, a tablet (such as said tablet 201*c*), a phone (such as said mobile phone 201*a*), and/or similar. Despite different form-factors, said one or more computers 102 can have similar basic hardware, such as a screen 202 and a one or more input devices (such as a keyboard 204*a*, a trackball 204*b*, a one or more cameras 204*c*, a wireless—such as RFID-reader, a track pad 204*d*, and/or a home button 220). In one embodiment, said screen 202 can comprise a touch screen. In one embodiment, said track pad 204*d* can function similarly to a computer mouse as is known in the art. In one embodiment, said tablet 201*c* and/or said personal computer 201*b* can comprise a Microsoft® Windows® branded device, an Apple® branded device, or similar. In one embodiment, said tablet 201*c* can be an X86 type processor or an ARM type processor, as is known in the art.

Said first network configuration 101 can comprise a data 206. In one embodiment, said data 206 can comprise data related to financial transactions.

In one embodiment, said one or more computers 102 can be used to input and view said data 206. In one embodiment, said data 206 can be input into said one or more computers 102 by taking pictures with one of said one or more camera 204*c*, by typing in information with said keyboard 204*a*, or by using gestures on said screen 202 (where said screen 202 is a touch screen). Many other data entry means for devices similar to said one or more computers 102 are well known and herein also possible with data 206. In one embodiment, said first computer 102*a* can comprise an iPhone®, a BlackBerry®, a smartphone, or similar. In one embodiment, one or more computers 102 can comprise a laptop computer, a desktop computer, or similar.

FIGS. 3A, 3B, 3C and 3D illustrate an address space 302 within said one or more computers 102, an address space 302*a*, an address space 302*b* and an address space 302*d*.

Each among said one or more computers 102 and said server 108 can comprise an embodiment of address space 302. In one embodiment, said address space 302 can comprise a one or more processors 304, a memory 306, and a communication hardware 308. In one embodiment, said one or more processors 304 can comprise a plurality of processors, said memory 306 can comprise a plurality of memory modules, and said communication hardware 308 can comprise a plurality of communication hardware components. In one embodiment, said data 206 can be sent to said one or more processors 304; wherein, said one or more processors 304 can perform processes on said data 206 according to an application stored in said memory 306, as discussed further below. Said processes can include storing said data 206 into said memory 306, verifying said data 206 conforms to a one or more preset standards, or ensuring a required set among said required data 206 has been gathered for said data management system and method. In one embodiment, said data 206 can include data which said one or more computers 102 can populate automatically, such as a date and a time, as well as data entered manually. Once a portion of gathering data has been performed said data 206 can be sent to said communication hardware 308 for communication over said network 106. Said communication hardware 308 can include a network transport processor for packetizing data, communication ports for wired communication, or an antenna for wireless communication. In one embodiment, said data 206 can be collected in one or more computers 102 and delivered to said server 108 through said network 106.

In one embodiment, said interactive toy 100 can comprise an integrated circuit 706 (not illustrated here) or a set of interconnected components which can comprise said address space 302*a*, a one or more processors 304*a*, a memory 306*a*, and a communication hardware 308*a*.

Likewise, in one embodiment, said second computer 102*b* can comprise said address space 302*b* which can comprise a one or more processors 304*b*, a memory 306*b*, and a communication hardware 308*b*. In one embodiment, said server 108 can comprise said address space 302*d*, a one or more processors 304*d*, a memory 306*d*, and a communication hardware 308*d*.

Figure 4A:
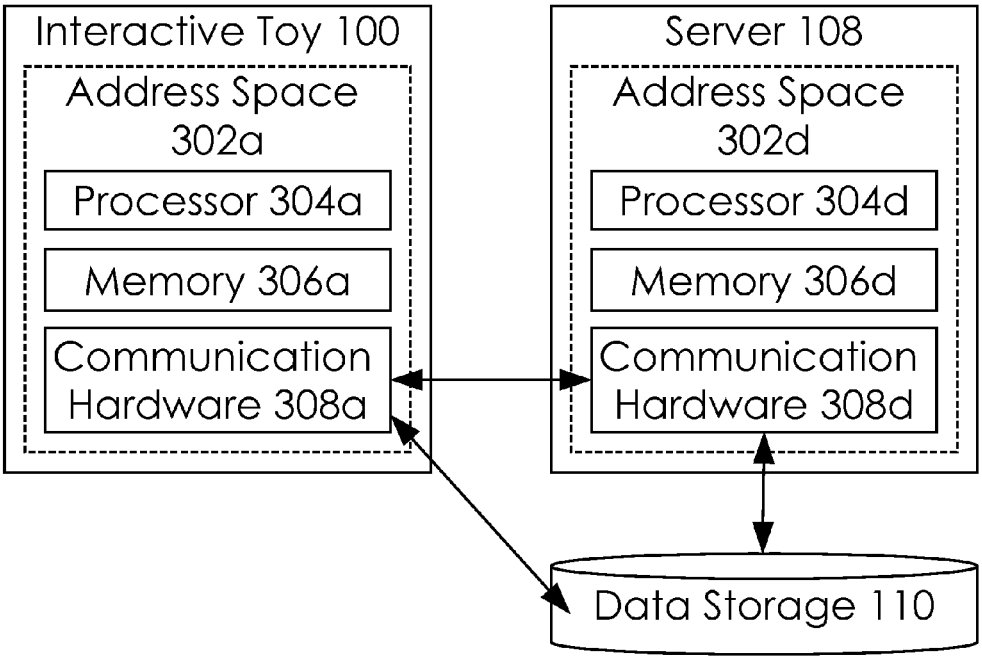
FIGS. 4A and 4B illustrate two embodiments for collecting and storing data with said first network configuration 101; a first embodiment with a flow diagram between said interactive toy 100 and said server 108, and a second embodiment comprising of just said interactive toy 100.
Figure 4B:
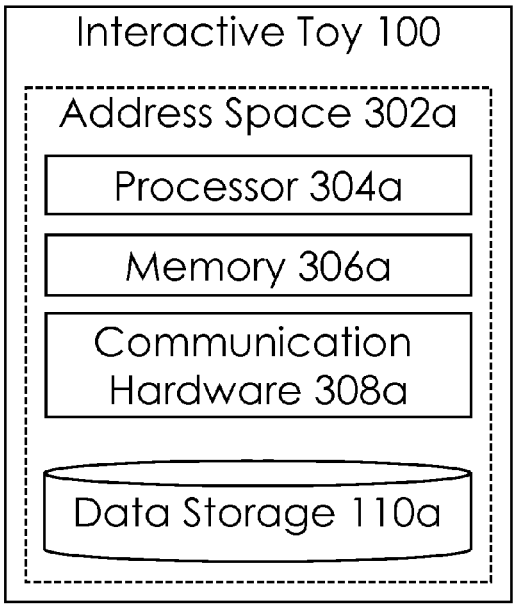

FIGS. 4A and 4B illustrate two embodiments for collecting and storing data with said first network configuration 101; a first embodiment with a flow diagram between said interactive toy 100 and said server 108, and a second embodiment comprising of just said interactive toy 100.

In the first embodiment, said communication hardware 308*a* and said communication hardware 308*d* can send and receive data to and from one another and or can communicate with said data storage 110 across said network 106. Likewise, in the second embodiment, data storage 110 can be embedded inside of said one or more computers 102 as a data storage 110*a*, which may speed up data communications by said first network configuration 101. In another embodiment, said data can be stored temporarily on said data storage 110*a* and later moved to said data storage 110 for backup and sharing purposes.

As illustrated in FIG. 4A, in one embodiment, said server 108 can comprise a third party data storage and hosting provider or privately managed as well.

As illustrated in FIG. 4B, said data storage 110 can be located on said interactive toy 100, here labeled as said data storage 110*a*. Thus, said interactive toy 100 can operate without a data connection out to said server 108 while performing said system and method for field capture of data.

Figure 5A:
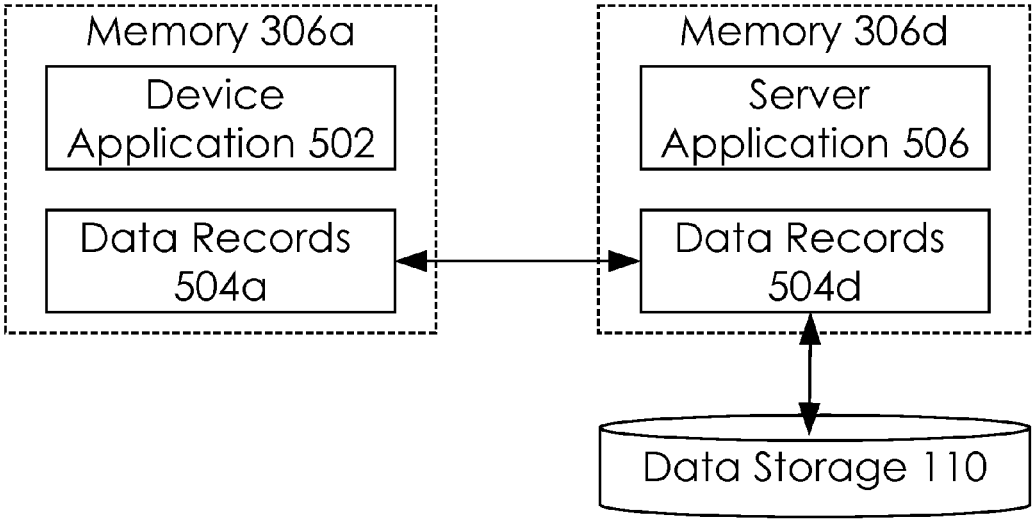
FIGS. 5A, 5B and 5C illustrate three examples of a flow diagram between said memory 306*a* and said memory 306*d*.
Figure 5B:
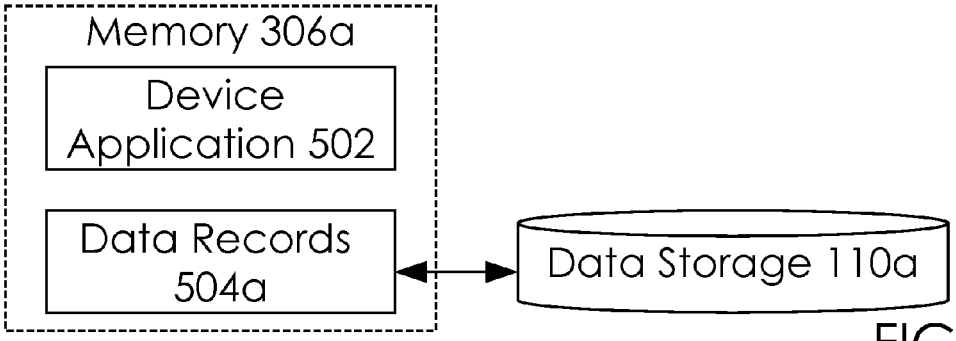
Figure 5C:
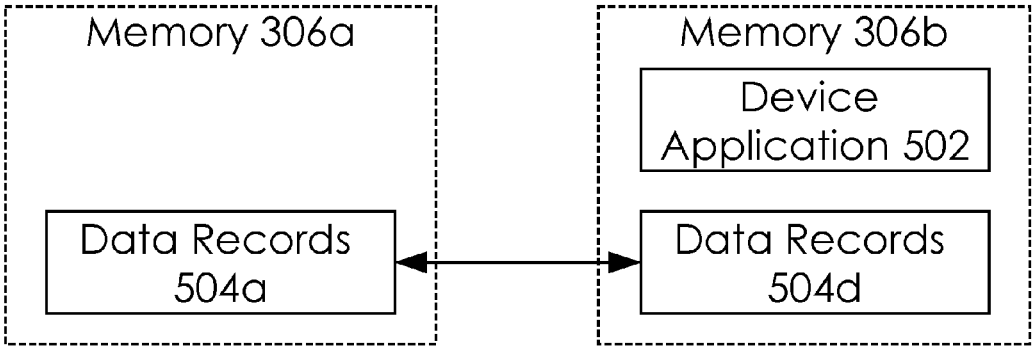

FIGS. 5A, 5B and 5C illustrate three examples of a flow diagram between said memory 306*a* and said memory 306*d*.

As illustrated in FIG. 5A, in one embodiment, said first network configuration 101 can process said data 206 on said interactive toy 100 and/or said server 108. For example, in one embodiment, said memory 306*a* can comprise a device application 502 capable of generating a data records 504*a* from user inputs or, otherwise, processing said data records 504*a* delivered to said device application 502 from said data storage 110. In one embodiment, said data records 504 can be transferred between said device application 502 on said memory 306*a* of said interactive toy 100 and a server application 506 in said memory 306*d* as a data records 504*d* of said server 108. In one embodiment, said server 108 can be useful for processing said data 206, as is known in the art.

As illustrated in FIG. 5B, in another embodiment, said server 108 can be removed from the flow diagram entirely as said memory 306*a* is capable of processing said data records 504 and/or said data 206 without the assistance of said server 108.

As illustrated in FIG. 5C, said interactive toy 100 can pass said data records 504*a* to another computer (such as said second computer 102*b*) for display and interaction on a device application 502. Said second computer 102*b* can modify said data records 504*a* into a data records 504*b*, and send a portion of said data records 504*b* back to said interactive toy 100. This round trip can be conducted over said first network configuration 101 or by other means, as is known in the art. In one embodiment, said data storage 110 may or may not be updated based on the result of changes to said data records 504*a* and/or said data records 504*b*.

Figure 6A:
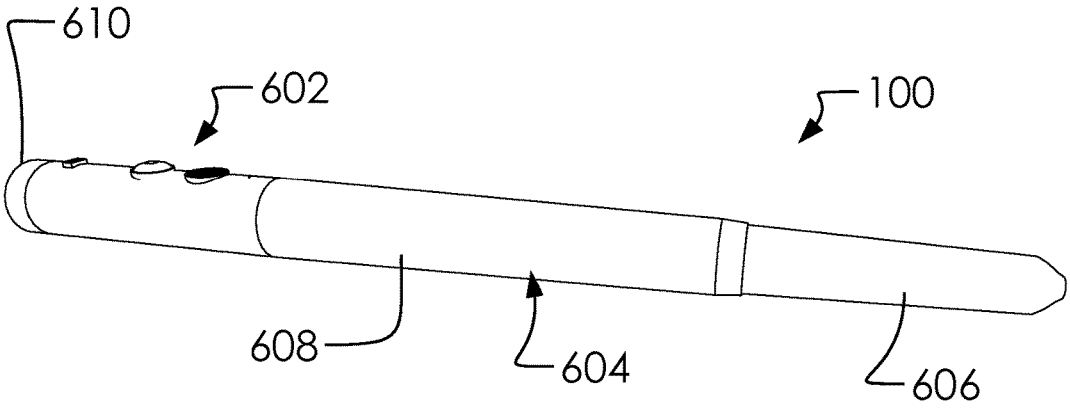
FIG. 6A illustrates a perspective overview of an interactive toy 100.
Figure 6B:
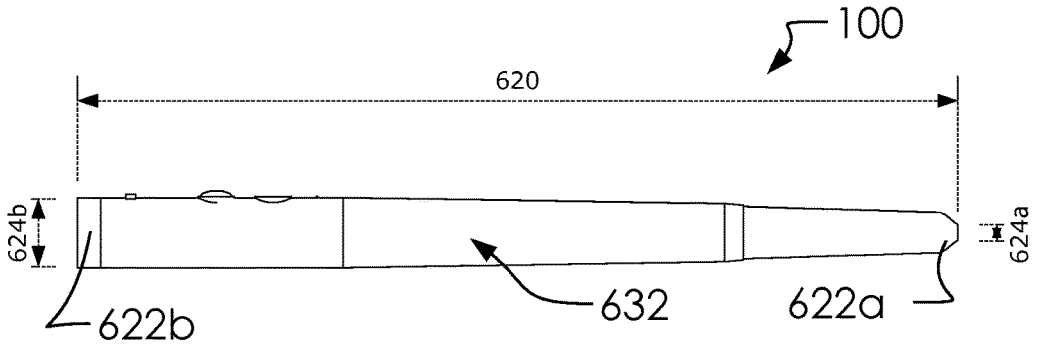
FIG. 6B illustrates an elevated front view of an interactive toy 100.
Figure 6C:
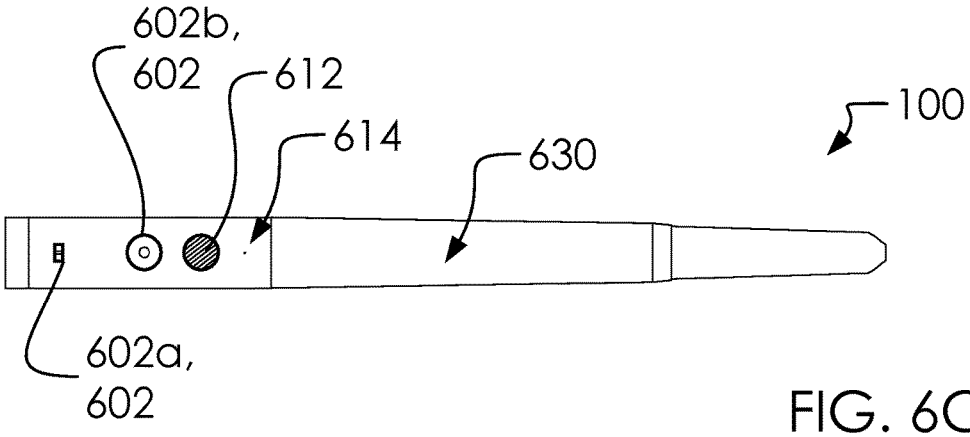
FIG. 6C illustrates a perspective top view of an interactive toy 100.

FIG. 6A illustrates a perspective overview of an interactive toy 100. FIG. 6B illustrates an elevated front view of an interactive toy 100. FIG. 6C illustrates a perspective top view of an interactive toy 100.

Illustrated herein are a one or more buttons 602, a first button 602*a*, a second button 602*b*, a third button 602*c*, an outer body 604, a tip portion 606, an upper portion 608, an end cap 610, a microphone 612, and a first LED 614.

In one embodiment, said one or more buttons 602 can comprise said first button 602*a*, said second button 602*b*, said third button 602*c*. In one embodiment, said outer body 604 can comprise said tip portion 606, said upper portion 608, and said end cap 610. In one embodiment, said tip portion 606 can comprise a male threading 714. In one embodiment, said upper portion 608 can comprise a female threading 710, a one or more apertures 712, a female threading 802, a battery compartment 902, and a upper compartment 904. In one embodiment, said end cap 610 can comprise a speaker compartment 702, a male threading 704, and a speaker 1002.

A summary of the functionality of said one or more buttons 602 is included in FIG. 11A, but here is a quick description of them in one embodiment: said first button 602*a* can comprise a power button; said second button 602*b* can playback an outgoing message and for use in recording a new incoming message; and said third button 602*c* can be used by the parent for management of messages recorded on said interactive toy 100 as well as administrate is operation.

As noted, said interactive toy 100 can comprise a device in the shape of a magic wand. It can be programmed to encourage the illusion of magical powers between said plurality of users 150. Each among said one or more buttons 602, said microphone 612, said first LED 614 and said speaker 1002 can be used to propagate the illusion.

In one embodiment, said interactive toy 100 can comprise a length 620, a first end 622*a* having a first diameter 624*a* and a second end 622*b* having a second diameter 624*b*. In one embodiment, said outer body 604 can comprise a top 630 and a first side 632. In one embodiment, said outer body 604 can comprise a generally conical shape where said second diameter 624*b* is larger than said first diameter 624*a* and said outer body 604 tapers down from said second end 622*b* to said first end 622*a*. Therefore, said interactive toy 100 can have a wand like shape, as might be expected based on the marketing embodiment described and illustrated herein. In one embodiment, said outer body 604 can comprise a generally circular shape when a cross-section is taken thereof as perpendicular with its length 620.

In one embodiment, a user of said interactive toy 100 can hold said interactive toy 100 at or near said second end 622*b*; wherein, said one or more buttons 602 can be located proximate to the anticipated gripping location, as illustrated.

In one embodiment, said end cap 610 can selectively attach to said upper portion 608, and said tip portion 606 can selectively attach to said upper portion 608.

In one embodiment, said first LED 614 can be located in said top 630 of said upper portion 608, as illustrated. However, said first LED 614 need not be restricted to this location. In another embodiment, said first LED 614 can be located proximate to said first end 622*a*. This alternate arrangement would provide a theatrical display of light when said interactive toy 100 is in use as a prop related to wish granting. Further, and as will be discussed in FIGS. 11A and 19, said first LED 614 can be used as a flashlight (or similar) during a long press of one of said one or more buttons 602. This feature would enable said interactive toy 100 to serve multiple purposes at no additional cost to the manufacturer.

Said microphone 612 can be located proximate to said one or more buttons 602, but again, there is no reason for it to be in this location. As would be obvious to one in the art, said microphone 612 need only be exposed so as to capture a useful audio recording at appropriate times.

Figure 7:
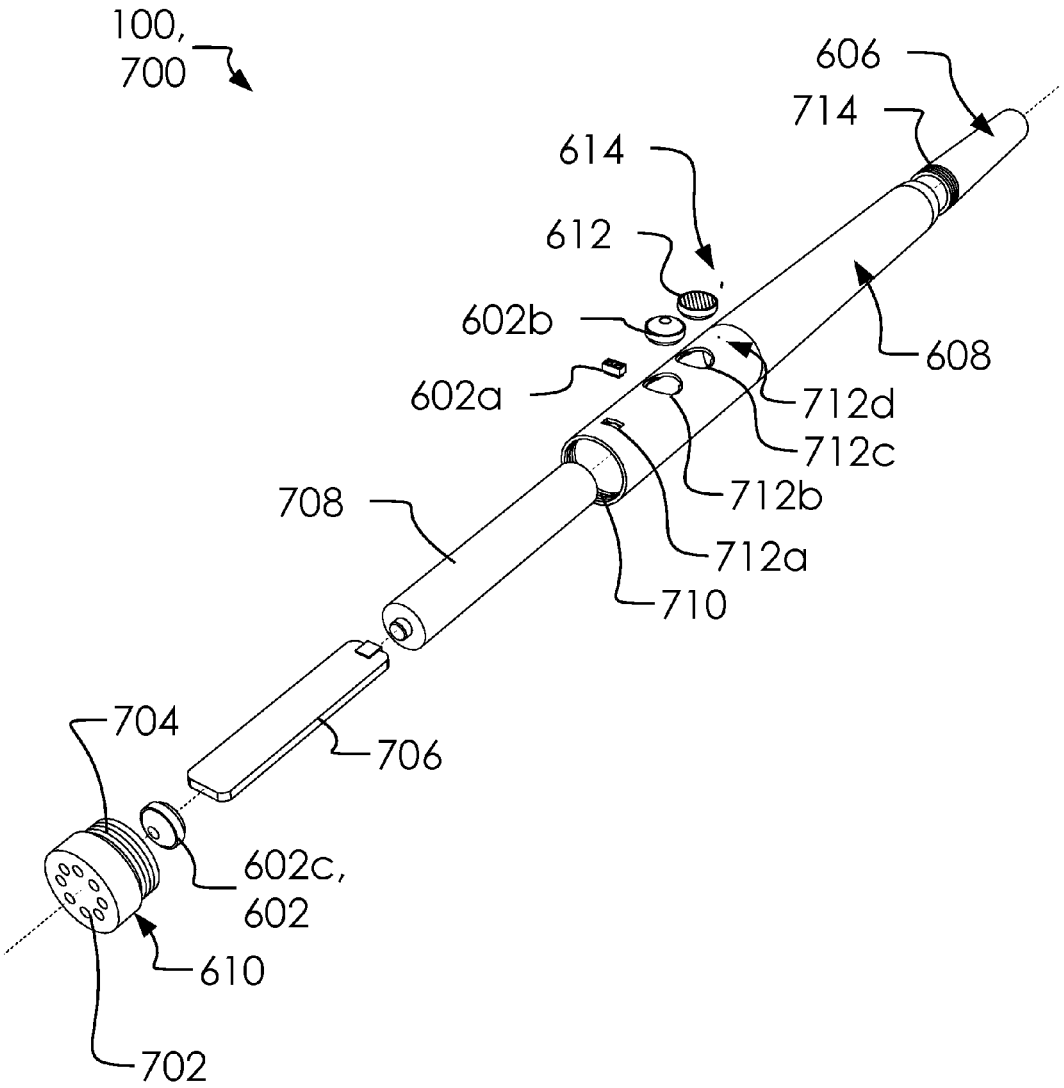
FIG. 7 illustrates an exploded perspective overview of an exploded view 700 of said interactive toy 100.

FIG. 7 illustrates an exploded perspective overview of an exploded view 700 of said interactive toy 100.

Illustrated herein are an exploded view 700, a speaker compartment 702, a male threading 704, an integrated circuit 706, a battery 708, a female threading 710, a one or more apertures 712, a first aperture 712*a*, a second aperture 712*b*, a third aperture 712*c*, a fourth aperture 712*d*, a male threading 714.

In one embodiment, said one or more apertures 712 can comprise said first aperture 712*a*, said second aperture 712*b*, said third aperture 712*c*, and said fourth aperture 712*d*.

In one embodiment, said end cap 610 selectively attaches to said upper portion 608 by screwing said male threading 704 into said female threading 710. In one embodiment, said first button 602*a* can be affixed within said first aperture 712*a*; said second button 602*b* within said second aperture 712*b*; said microphone 612 within said third aperture 712*c*; and said first LED 614 within said fourth aperture 712*d*.

As illustrated here, a one or more LED's can be included in said interactive toy 100. For example, in one embodiment, said first LED 614 is affixed in said upper portion 608 in said fourth aperture 712*d*. Likewise, in one embodiment, others among said one or more LED's can be included in said tip portion 606 or said end cap 610.

In one embodiment, said integrated circuit 706 can comprise a system on a chip or system on chip (SoC or SOC). In one embodiment, said integrated circuit 706 can comprise an integrated circuit (IC) that integrates all components of a computer or other electronic system into a single chip. It may contain digital, analog, mixed-signal, and often radio-frequency functions—all on a single chip substrate. SoCs are very common in the mobile electronics market because of their low power consumption. A typical application is in the area of embedded systems. In one embodiment, said integrated circuit 706 can comprise an amplifier, those parts illustrated in said address space 302*a* (such as said one or more processors 304*a*, said memory 306*a* and said communication hardware 308*a*), and similar, as is known in the art.

Illustrated here are the components in said interactive toy 100 in an exploded view. Missing from these illustrations are the wires connecting each of the parts, said one or more buttons 602, said first LED 614, said microphone 612 and/or said speaker 1002. It would be obvious to one of skill in the art how wire these parts, and others not illustrate, to said integrated circuit 706. Thus, the lack of a positive and negative port associated with said battery 708 does not render these figures incomplete or non-enabling.

In one embodiment, said first button 602*a* can comprise a switch having an on and an off position, as is known in the art. In another embodiment, said first button 602*a* can comprise a push button which alternates a power status of said interactive toy 100.

In one embodiment, said speaker 1002 can be attached to an amplifier to boost a signal from said integrated circuit 706 for said plurality of users 150.

In one embodiment, said third button 602*c* can only be accessed within said upper portion 608 by removing said end cap 610. Accordingly, said first user 150*a* can regulate access to, or knowledge of, said third button 602*c* from said second user 150*b*. In one embodiment, said third button 602*c* is unnecessary where said interactive toy 100 is in data communication with said device application 502, as described in this disclosure. It is conceivable, that said interactive toy 100 could be operated with only one button.

Figure 8:
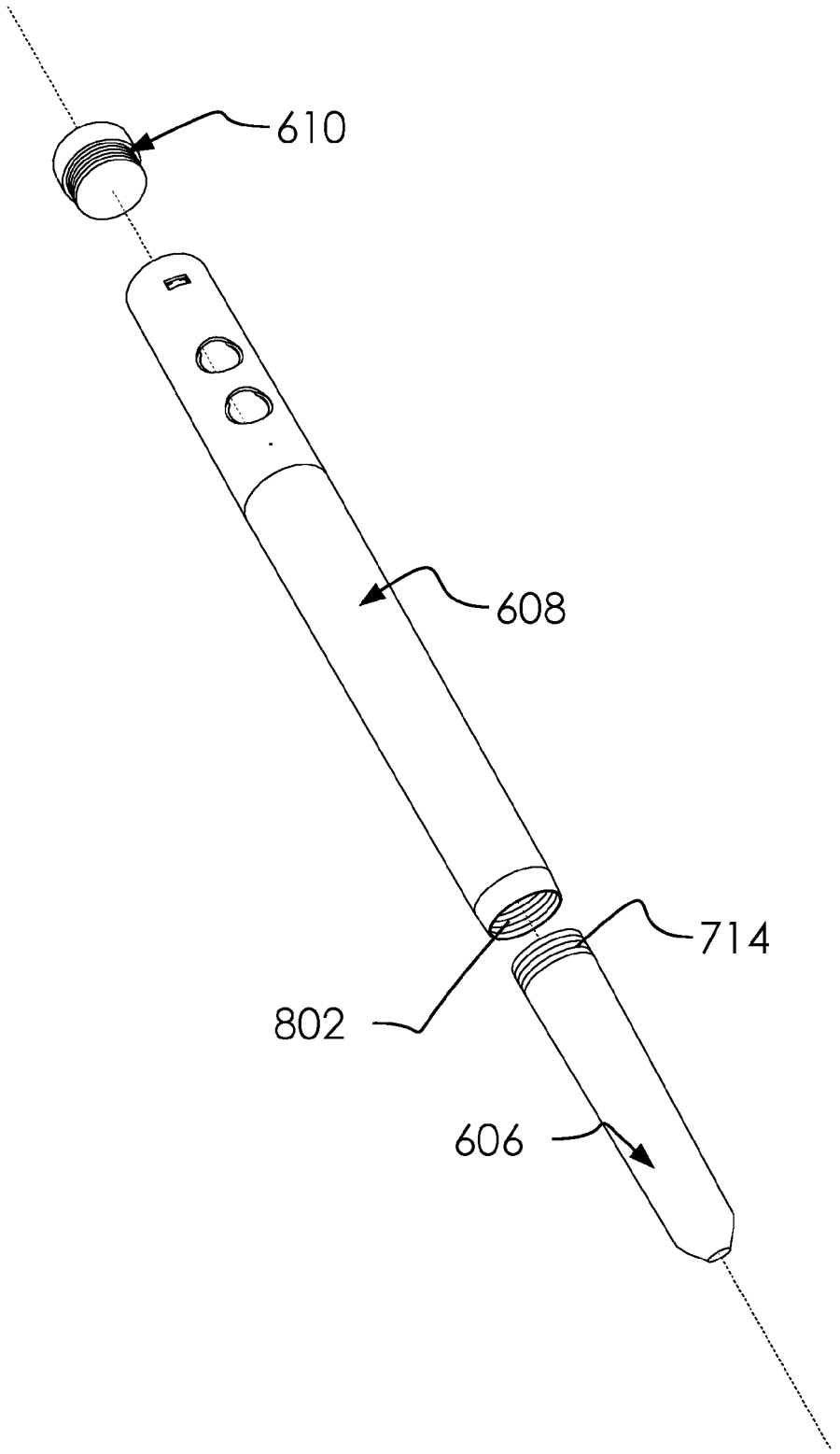
FIG. 8 illustrates an exploded perspective overview of an interactive toy 100.

FIG. 8 illustrates an exploded perspective overview of an interactive toy 100.

Illustrated herein are a female threading 802.

In one embodiment, said tip portion 606 and said upper portion 608 can attach to one another by screwing said male threading 714 into said female threading 802.

In one embodiment, said tip portion 606 can be integrated into said upper portion 608 and therefore eliminate the need for said male threading 714 and said female threading 802.

Likewise, in one embodiment, said end cap 610 can selectively attach to said upper portion 608 by means known in the art, rather than a threading, as illustrated.

Figure 9:
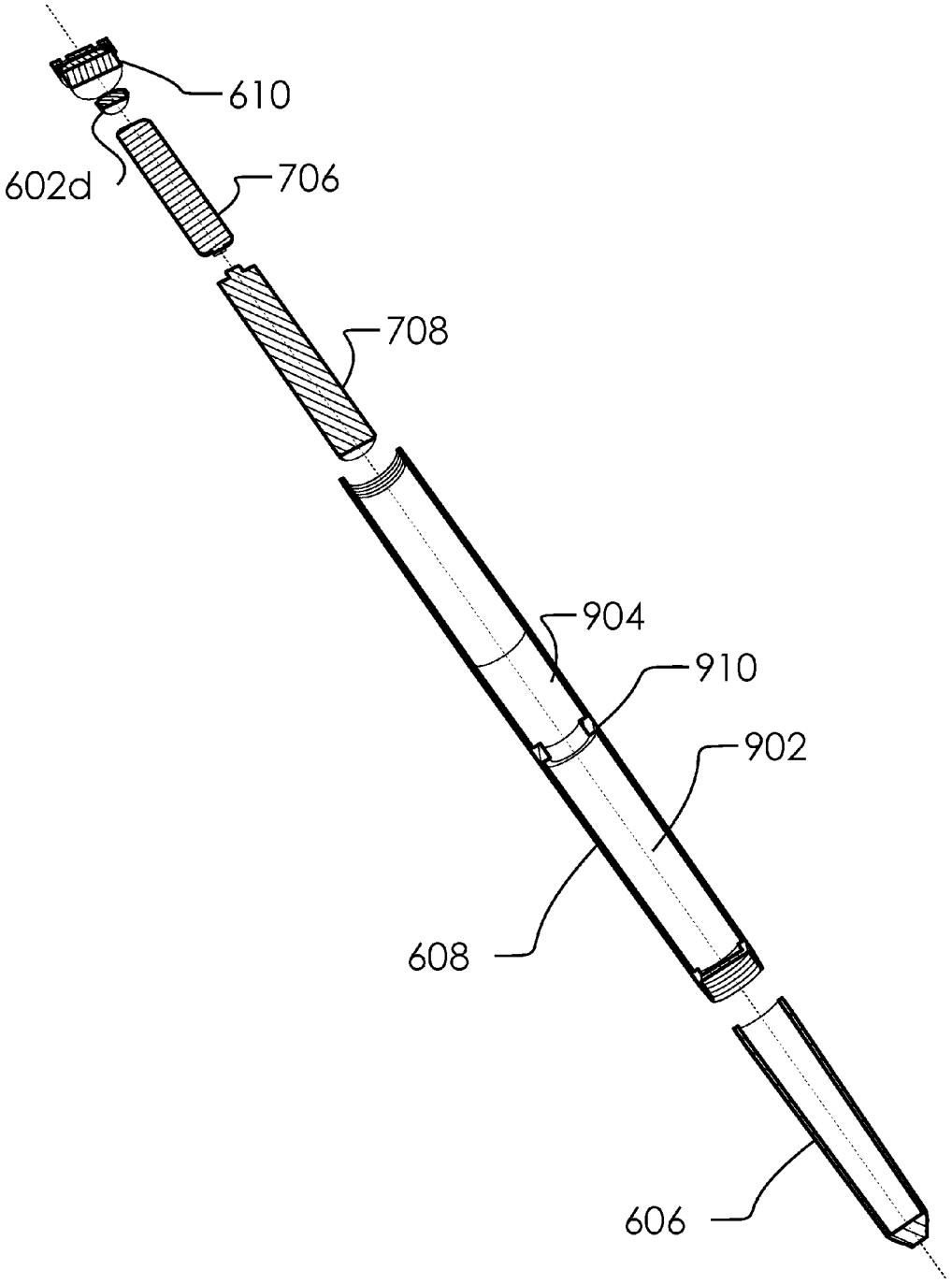
FIG. 9 illustrates a cross-section, exploded, perspective overview of an interactive toy 100.

FIG. 9 illustrates a cross-section, exploded, perspective overview of an interactive toy 100.

Illustrated herein are a battery compartment 902, an upper compartment 904.

In one embodiment, said battery 708 is selectively held in said battery compartment 902, and said integrated circuit 706 is selectively held in said upper compartment 904. In one embodiment, said integrated circuit 706 can be powered by said battery 708. In one embodiment, said one or more buttons 602 can be attached to said integrated circuit 706. In one embodiment, with said interactive toy 100 fully assembled, each of its components can be secured and relative movement between the components can be minimized.

In one embodiment, said battery compartment 902 can comprise an internal collar 910 for securing said battery 708 within said battery compartment 902.

Figure 10:
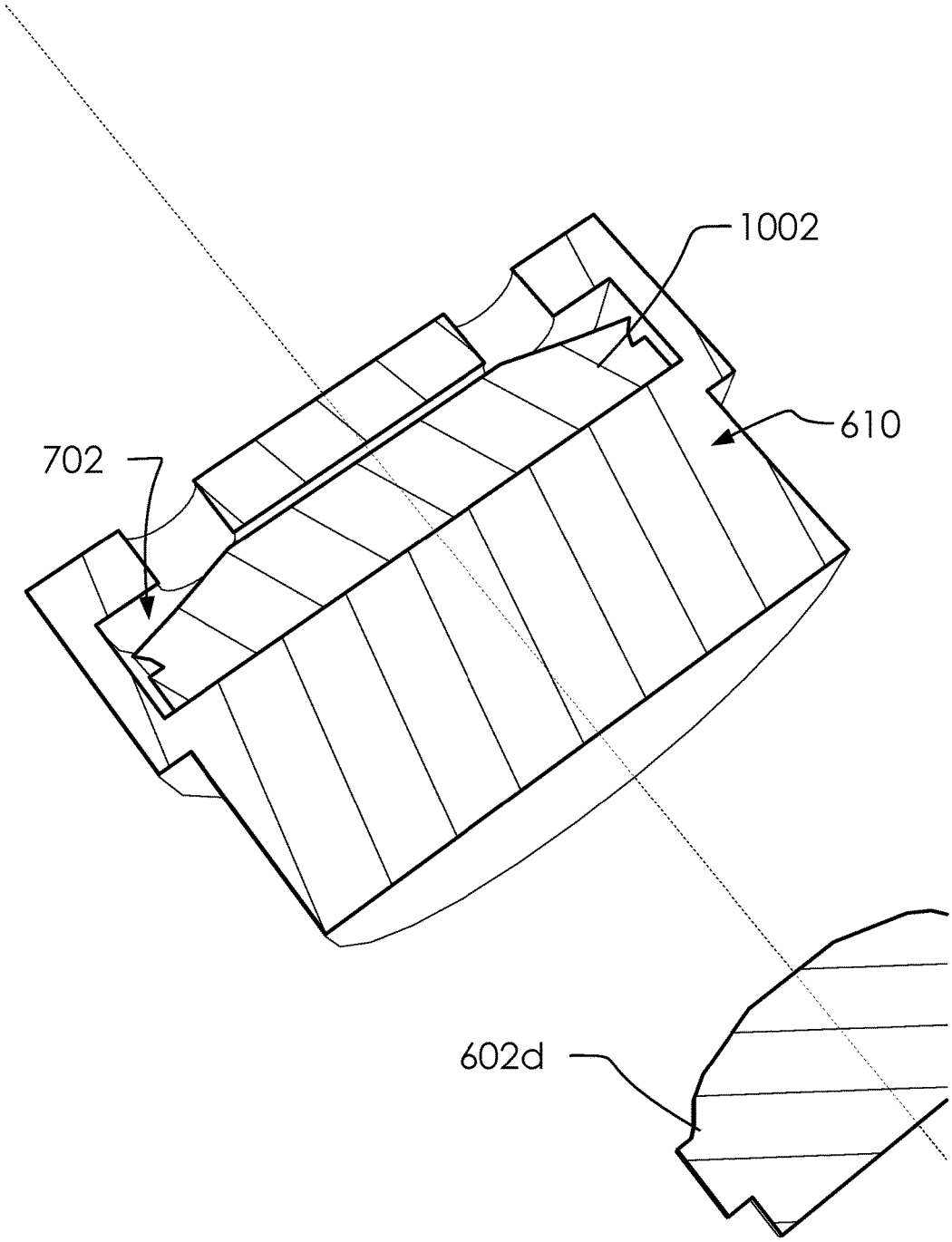
FIG. 10 illustrates a cross-section, exploded, perspective overview of an end cap 610.

FIG. 10 illustrates a cross-section, exploded, perspective overview of an end cap 610.

Illustrated herein are a speaker 1002.

In one embodiment, said speaker 1002 can be stored within said speaker compartment 702 of said end cap 610, as illustrated. In one embodiment, said speaker 1002 can be attached to said integrated circuit 706.

In one embodiment, said speaker compartment 702 can be accessed by removing a portion of said end cap 610 to expose said speaker 1002 therein. This procedure is not illustrated here, but would be known in the art. For example, in one embodiment, said speaker compartment 702 could be accessed by screwing a portion of said end cap 610 apart to expose said speaker 1002.

FIG. 11A illustrates a view of a button press to action table 1100.

Illustrated herein are a button press to action table 1100, a button description 1102, a single click action 1104, a double click action 1106, a triple click action 1108, and a hold button action 1110.

In one embodiment, said button press to action table 1100 can comprise said button description 1102, said single click action 1104, said double click action 1106, said triple click action 1108, said hold button action 1110, a wish granting procedure 1400, a set wishing mode 1500, a playback wishes 1700, a record new messages dialog 1800, an activate-deactivate LEDs 1900 and an activate pairing mode 2000. As would be obvious to one in the art, said button press to action table 1100 can be read as a matrix between which sequence of button presses are pressed (such as said single click action 1104, said double click action 1106, said triple click action 1108, and/or said hold button action 1110) corresponding with which button among said one or more buttons 602 has been pressed. The corresponding cell represents a resulting procedure. For example, in one embodiment, where said first button 602*a* is clicked one time (see said single click action 1104), then the result is a power on/off procedure, as is known in the art.

In one embodiment, said button description 1102 matrix assumes that said one or more buttons 602 comprise a plurality of buttons. However, there are circumstances that said interactive toy 100 can be enabled on as few as one button. For example, in one embodiment, said button description 1102 can comprise additional multiple click options associated with each among the options outlined in said button press to action table 1100. Accordingly, in one embodiment, actions described in said button press to action table 1100 can be described as a one or more user inputs. In one embodiment, said one or more user inputs can comprise a first user action which can comprise said wish granting procedure 1400. His language can be used in the claims to describe inputs according to said button press to action table 1100. Additional and necessary inputs which may not be included in said button press to action table 1100 and which are known in the art, are hereby incorporated by reference.

In one embodiment, said integrated circuit 706 can comprise said memory 306*a* associated with storage of said data as illustrated and discussed. In one embodiment, the number of records that can be stored (including said WishRecording 1208 and said Recording 1306). So, for example, in one embodiment, said memory 306*a* can only store 5 minutes of audio recordings. In such an embodiment, said interactive toy 100 can be configured to keep the most recent recordings in said WishTable 1112 and/or said OutgoingMessagesTable 1114, according to user or developer preferences. In one embodiment, a record in said WishTable 1112 can be given preference over an abundance of records in said OutgoingMessagesTable 1114.

FIG. 11B illustrates a view of a data relationship diagram 1111.

Illustrated herein are a data relationship diagram 1111 comprising a one or more tables comprising a WishTable 1112, an OutgoingMessagesTable 1114, a PairingTable 1118, a SysSettingsTable 1120, and a VendorOffersTable 1122.

In one embodiment, said data relationship diagram 1111 can comprise a set of database tables stored in said memory 306*a* and managed by said one or more processors 304*a* of said interactive toy 100, as is known in the art. In one embodiment, said WishTable 1112 can comprise a one to many relationship with said OutgoingMessagesTable 1114, as described below. Likewise, in one embodiment, said WishTable 1112 can comprise a one to many relationship with said VendorOffersTable 1122.

As illustrated, the records in said data relationship diagram 1111 can comprise unique identifiers for each of the tables, as is known in the art.

In one embodiment, said PairingTable 1118 and said SysSettingsTable 1120 can each comprise no relationship to the other tables in said data relationship diagram 1111. Accordingly, data in these tables can be independent in nature.

FIG. 12A illustrates a view of a WishTable 1112.

Illustrated herein are an EventID 1202, an EventDate 1204, a GrantReference 1206, a WishRecording 1208, a GrantFlag 1210, an Unread 1212, a Delete 1214, and a Transcription 1216.

In one embodiment, said WishTable 1112 can comprise a table holding data related to events related to said second user 150*b*, or, related to pressing said second button 602*b*.

That is, said WishTable 1112 is a history of messages being recorded and the events related to those incoming messages.

Said EventID 1202 can comprise a unique ID for said WishTable 1112. Said EventDate 1204 can comprise a date when a record was created. Said GrantReference 1206 can comprise a cross reference to records in said OutgoingMessagesTable 1114. Said WishRecording 1208 can comprise an embedded binary file, or else, a reference thereto. Said GrantFlag 1210 can comprise a flag indicating whether the current record resulted in a grantable request by said second user 150*b*. Said Unread 1212 can comprise a flag as to whether said first user 150*a* has reviewed the current record. Said Delete 1214 can comprise a flag to indicate whether said interactive toy 100 should delete the current record or not. Said Transcription 1216 can comprise a transcription of said WishRecording 1208, whether done in software (automatically) or manually by a human listener.

FIG. 12B illustrates a view of a PairingTable 1118.

In one embodiment, said PairingTable 1118 can comprise an ID 1220, a DeviceDesc 1222, a DeviceID 1224, a DatePaired 1226, and a DateRemoved 1228.

In one embodiment, said ID 1220 can comprise a unique ID for each record in said PairingTable 1118. Said DeviceDesc 1222 can comprise a description of a device being paired with said interactive toy interactive toy 100. Said DeviceDesc 1222 can be populated at random, as the result of a header sent by a pairing device, or in any other manner known in the art. In one embodiment, said DeviceID 1224 can comprise a unique ID associated with the device being paired with said interactive toy 100, such as a MAC address, or similar. In one embodiment, said DatePaired 1226 can comprise a date when a record is created and said DeviceDesc 1222 is paired therewith. Said DateRemoved 1228 can comprise a date field indicated on what date a device was removed from being paired with said interactive toy 100. In one embodiment, the fields in said PairingTable 1118 can be accessed through said device application 502, as described below.

FIG. 12C illustrates a view of a SysSettingsTable 1120.

In one embodiment, said SysSettingsTable 1120 can comprise an ID 1240, a DateChanged 1242, a WishingMode 1244, a LEDSolid 1246, and a LEDFlashing 1248.

In one embodiment, each record in said SysSettingsTable 1120 can comprise a state of the settings in said interactive toy 100. In one embodiment, the only record to matter can comprise the most recent record in said SysSettingsTable 1120 as measured by said DateChanged 1242. In one embodiment, older records can be systematically deleted. In one embodiment, fields in said SysSettingsTable 1120 are just representative of a configuration file associated with said interactive toy 100, rather than a relational database table, as illustrated.

The data kept in these exemplary tables may not correspond perfectly with the programmatic logic presented in FIGS. 14-20. These discrepancies do not disqualify this disclosure and should be considered different embodiments where conflict is found.

FIG. 13A illustrates a view of said OutgoingMessagesTable 1114.

Said OutgoingMessagesTable 1114 can comprise a GrantID 1302, a Grant 1304, a Recording 1306, an InUse 1308, a TimesUsed 1310, and a CountDownUse 1312.

In one embodiment, said OutgoingMessagesTable 1114 can comprise a table holding data prepared by said first user 150*a* for use in communicating with said second user 150*b*. In one embodiment, said OutgoingMessagesTable 1114 can be summarized as a collection of outgoing messages used to direct and encourage another user to input incoming messages. Said OutgoingMessagesTable 1114 can further comprise provisions for sequencing its records and for elevating certain records to a "wish granting" status.

In one embodiment, said GrantID 1302 can comprise a unique identifier field for said OutgoingMessagesTable 1114. In one embodiment, said Grant 1304 can comprise a flag indicating whether an outgoing message is associated with a grantable wish opportunity, as described herein. Said Recording 1306 can comprise a reference to or an embedded binary recording to be played for said second user 150*b* when a particular record is identified for use. In one embodiment, said InUse 1308 can comprise a flag to indicate whether a current record is currently in use by said interactive toy 100 or if it should be ignored during the playback for said second user 150*b*. In one embodiment, said TimesUsed 1310 can comprise an integer to record how many times an outgoing message (or record in this context) has been played back on said interactive toy 100. In one embodiment, said CountDownUse 1312 can comprise an integer used to sequence and prepare each among said records in said OutgoingMessagesTable 1114 by said interactive toy 100.

In one embodiment, said OutgoingMessagesTable 1114 can be updated on said interactive toy 100 or on said device application 502, as discussed below.

In one embodiment, records in said OutgoingMessagesTable 1114 can be preconfigured for said interactive toy 100 at the manufacturer's site. In another embodiment, records in said OutgoingMessagesTable 1114 can be custom made by said first user 150*a* for a portion of said plurality of users 150 (such as said second user 150*b*).

FIG. 13B illustrates a view of said VendorOffersTable 1122.

In one embodiment, said VendorOffersTable 1122 can comprise data collected by one or more merchants which are selected for offering items for sale related to wishes placed into said interactive toy 100 by said plurality of users 150.

In one embodiment, said SysSettingsTable 1120 can comprise an ID 1320, a WishReference 1322, a VendorName 1324, a ToyName 1326, an ItemID 1328, a PriceOffer 1330, and an AppProfit 1332.

In one embodiment, said PriceOffer 1330 can comprise a unique ID for fields in said VendorOffersTable 1122. Said WishReference 1322 can comprise a reference to fields in said WishTable 1112. Said VendorName 1324 can comprise a name of a vendor making an offer. Said ToyName 1326 can comprise a description of an item being offered to said plurality of users 150. Said ItemID 1328 can comprise a unique identifier as related to said ToyName 1326 as set by said VendorName 1324. In another embodiment, said ItemID 1328 can comprise a unique identifier for said ToyName 1326 as set by a neutral third party, such as a bar code or similar. In one embodiment, said PriceOffer 1330 can comprise a price that said ToyName 1326 has been offered to said plurality of users 150. Occasionally, said ToyName 1326 can comprise a discount coupon for an item where such an offer seems appropriate. For example, in one embodiment, said ToyName 1326 can comprise goods for sale, such as a bike, or a coupon to be applied at a later time. In one embodiment, said AppProfit 1332 can comprise a kickback or payment made to the owner/operator of said device application 502. Accordingly, said device application 502 has a revenue stream available to it for fulfilling these wishes. This incentive should keep interest in said interactive toy 100 and thereby make the experience of using it more robust and useful for everyone. In one embodiment, said AppProfit 1332 will not be show to end users of said interactive toy 100, but said interactive toy 100 may include it on said server 108 for internal record keeping and accounting.

Figure 14:
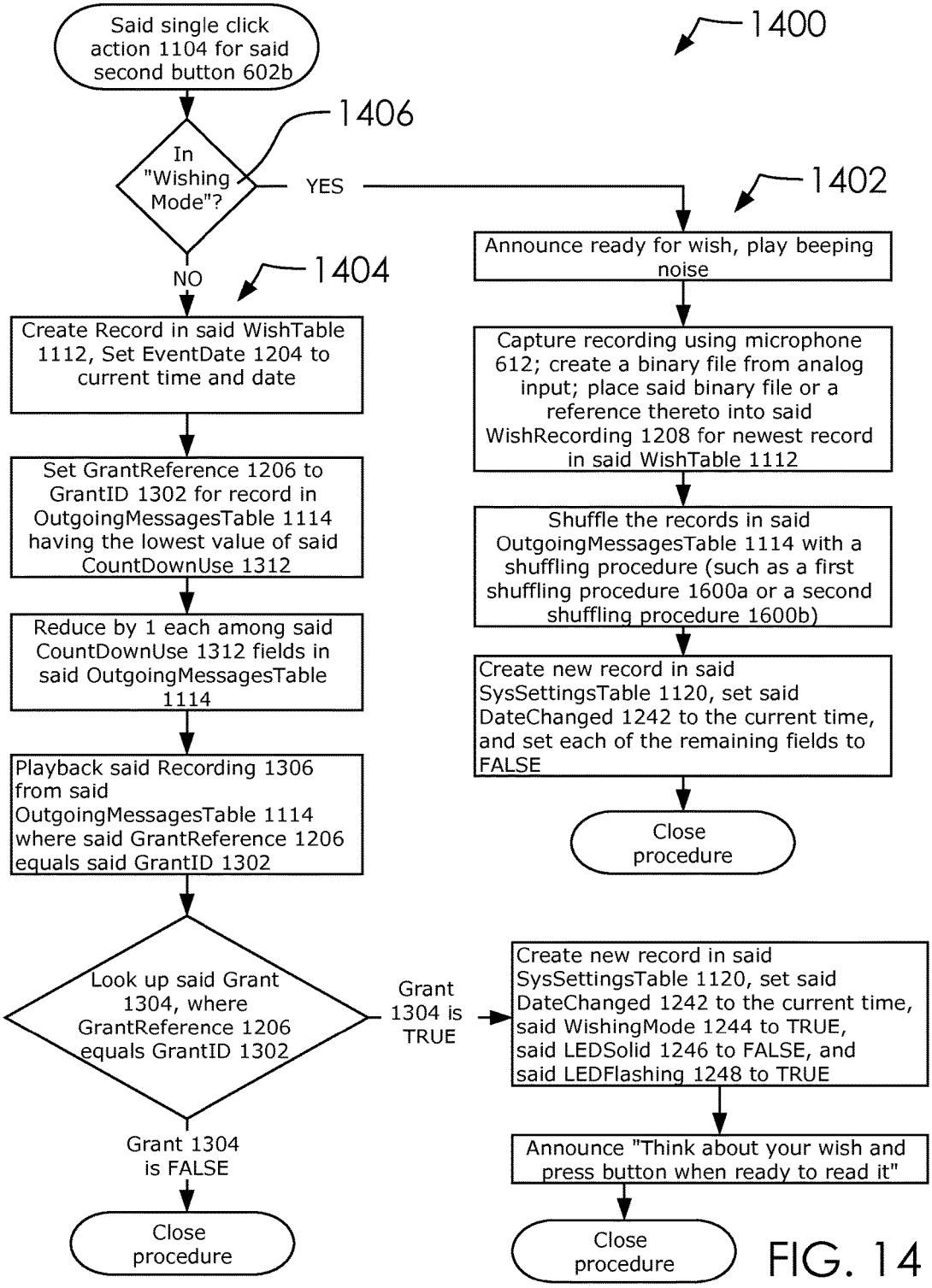
FIG. 14 illustrates a flowchart view of a wish granting procedure 1400.

FIG. 14 illustrates a flowchart view of a wish granting procedure 1400.

In one embodiment, said wish granting procedure 1400 can be used to react when said second user 150*b* has pressed said second button 602*b*. In one embodiment, pressing said second button 602*b* one time with said single click action 1104.

It will be helpful to note that one objective of this procedure is to demonstrate that one button (namely said second button 602*b*) can be used to launch multiple procedures. In this case, the two procedures are occur in sequence with one another. These sub-procedures of said wish granting procedure 1400 can comprise a wish collection procedure 1402 and a wish determination procedure 1404. In one embodiment, said sub-procedures chosen by using said WishingMode 1244 flag to determine which to engage. Accordingly, in one embodiment, said wish granting procedure 1400 can comprise a wishing mode determination 1406 to route the procedure between said wish collection procedure 1402 and said wish determination procedure 1404, as illustrated.

In one embodiment, said wish determination procedure 1404 can comprise creating and populating a record in said WishTable 1112. As illustrated, said wish determination procedure 1404 takes time to prepare said OutgoingMessagesTable 1114 for shuffling and future use. Then, said wish determination procedure 1404 plays back a recording associated with one of the records in said OutgoingMessagesTable 1114 and sets said WishingMode 1244 based on the nature of the recording played back, among much else, as illustrated. Said wish determination procedure 1404, therefore preforms many functions related to setting the stage for the collection of wishes from said plurality of users 150.

Eventually, said wish granting procedure 1400 will terminate with said WishingMode 1244 set to TRUE. Accordingly, said wish granting procedure 1400 will occasionally launch into said wish collection procedure 1402 and collect a wish from said plurality of users 150, for example, said second user 150*b*.

Said wish collection procedure 1402 can collect an incoming message from one among said plurality of users 150, store that message in said OutgoingMessagesTable 1114, and then prepare said interactive toy 100 to launch said wish granting procedure 1400 with said WishingMode 1244 set to FALSE. This might be thought of resetting said interactive toy 100 after allowing for a wish.

In one embodiment, said interactive toy 100 can take a time out period before allowing users to keep recording wishes, as desired by users, and as would be understood by persons skilled in the art.

Figure 15:
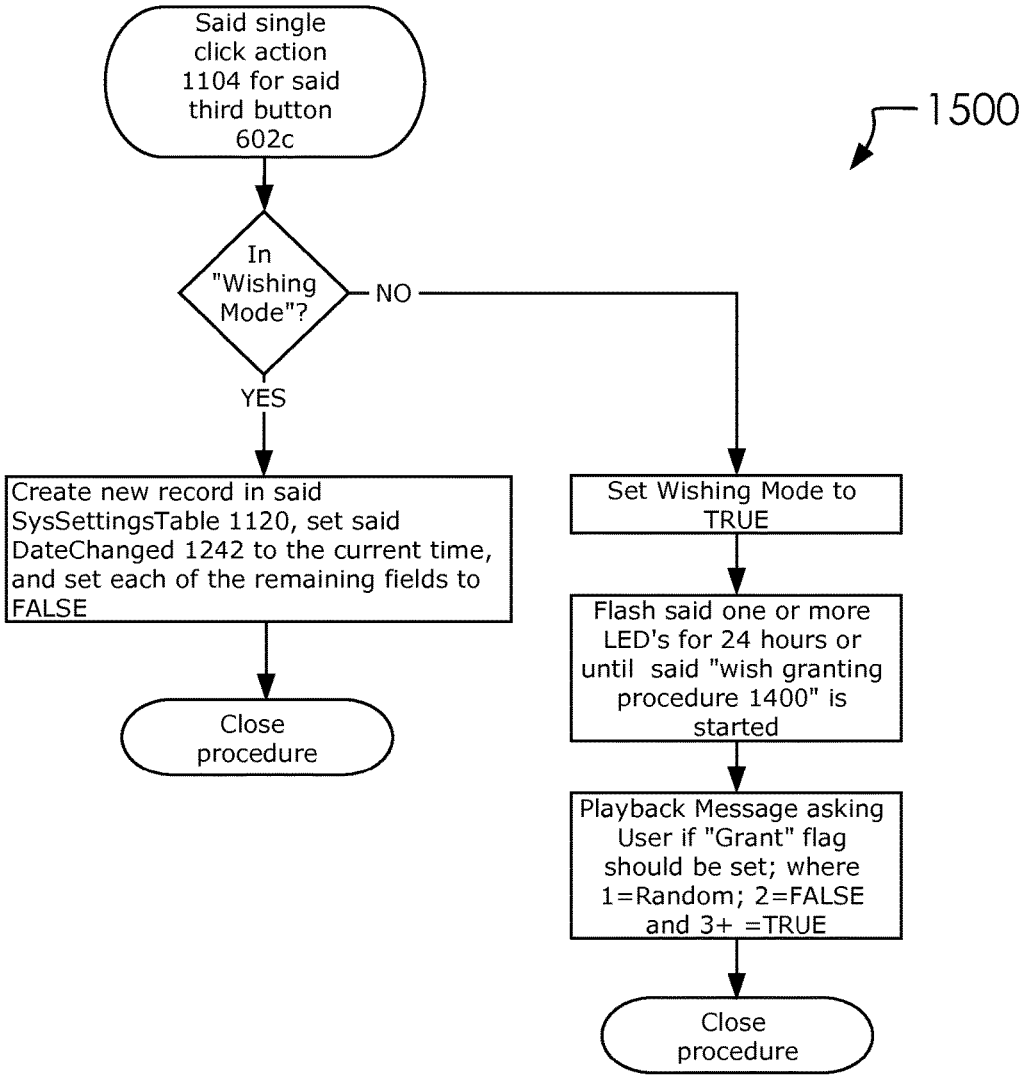
FIG. 15 illustrates a flowchart view of a set wishing mode 1500.

FIG. 15 illustrates a flowchart view of a set wishing mode 1500.

There might be cases where one among said plurality of users 150 may wish to set said interactive toy 100 into said wishing mode by setting said WishingMode 1244 to TRUE. In one embodiment, said set wishing mode 1500 can alternate the flag associated with said WishingMode 1244 by pressing said third button 602*c*. Note that said third button 602*c* can be hidden within said upper portion 608 of said interactive toy 100. Accordingly, said set wishing mode 1500 may be hidden from those among said plurality of users 150 that are not aware of said third button 602*c*.

In one embodiment, said wishing mode can be associated with said WishingMode 1244 set to TRUE, as described above, but can further be associated with said first LED 614 flashing or lighted up. Accordingly, said interactive toy 100 can draw attention to itself when in said wishing mode.

Figure 16A:
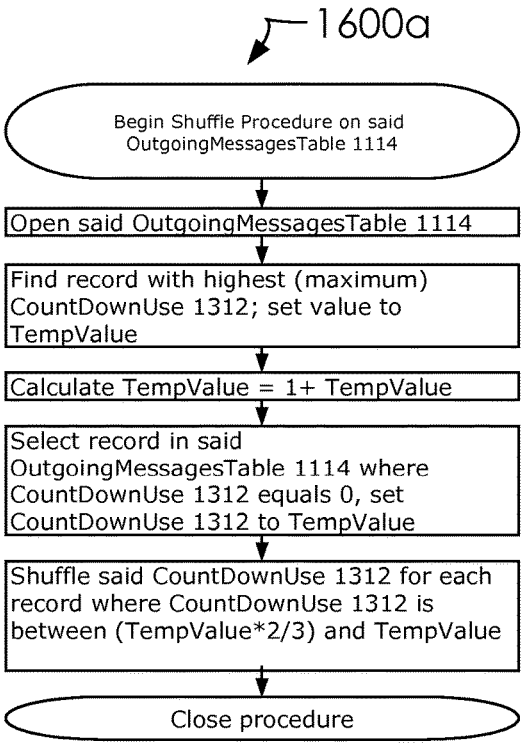
FIGS. 16A, 16B and 16C illustrate a first shuffling procedure 1600*a*, a second shuffling procedure 1600*b* and a five step progression 1600*c* of said OutgoingMessagesTable 1114 as under said first shuffling procedure 1600*a*.
Figure 16B:
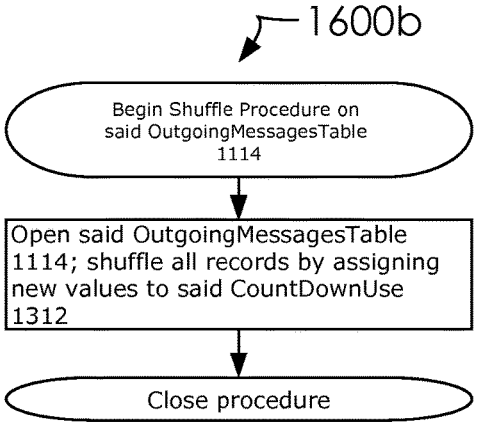
Figure 16C:
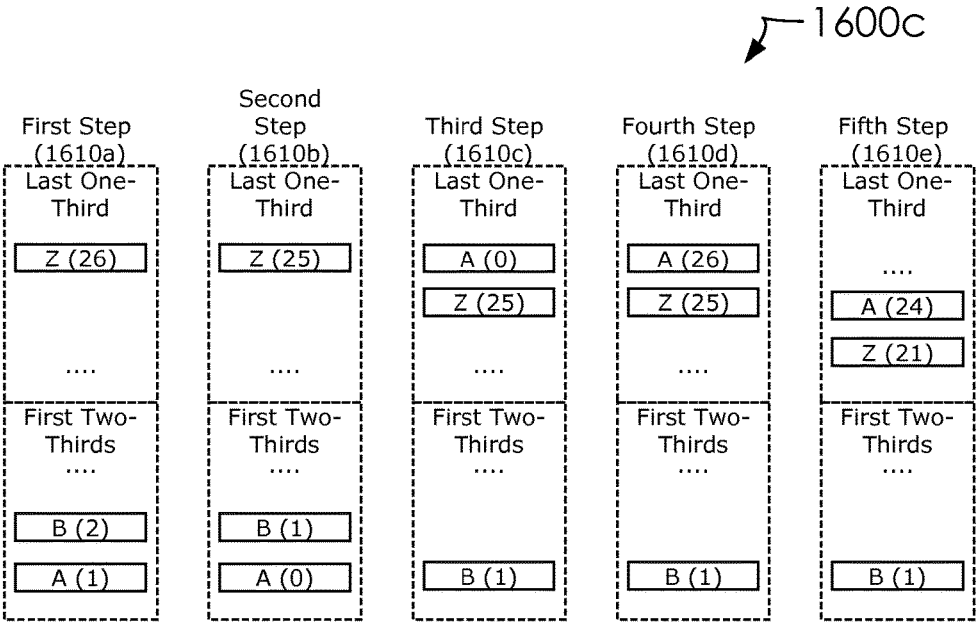

FIGS. 16A, 16B and 16C illustrate a first shuffling procedure 1600*a*, a second shuffling procedure 1600*b* and a five step progression 1600*c* of said OutgoingMessagesTable 1114 as under said first shuffling procedure 1600*a*.

In one embodiment, said first shuffling procedure 1600*a* can comprise a procedure for shuffling the last one-third of records in said OutgoingMessagesTable 1114 without shuffling a first two-thirds thereof. The purpose of this approach is to ensure random output from said interactive toy 100 while minimizing repeat use of the records in said OutgoingMessagesTable 1114, as is known in the art.

In one embodiment, said second shuffling procedure 1600*b* can comprise a complete randomization of use of the records in said OutgoingMessagesTable 1114. Naturally, this is the easier of the two alternatives to program.

Said five step progression 1600*c* can comprise a five steps 1610 which can comprise a first step 1610*a*, a second step 1610*b*, a third step 1610*c*, a fourth step 1610*d*, and a fifth step 1610*e*. In one embodiment, said five step progression 1600*c* can illustrate the steps of said first shuffling procedure 1600*a* as applied to hypothetical values in said OutgoingMessagesTable 1114.

Figure 17:
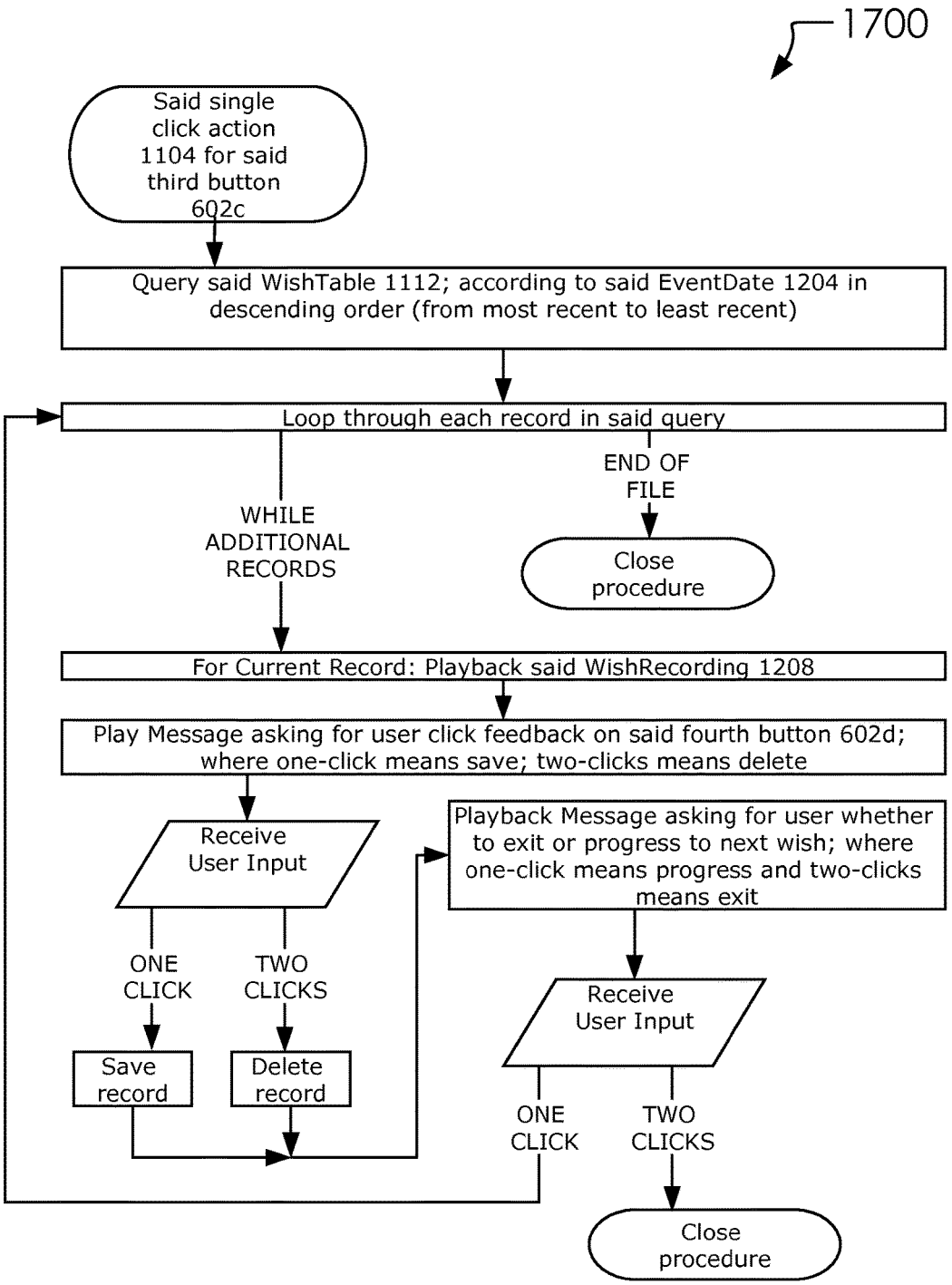
FIG. 17 illustrates a flowchart view of a playback wishes 1700.

FIG. 17 illustrates a flowchart view of a playback wishes 1700.

Said playback wishes 1700 can be similar to old fashioned methods for playing back voice messages on a telephone answering service. The user, such as said first user 150*a*, works his way through a stack of pending messages until reaching the loop. This processes is linear, slow, but generally understood and functional.

An alternative to this procedure may available under said device application 502, but this will be described in more detail below.

Figure 18:
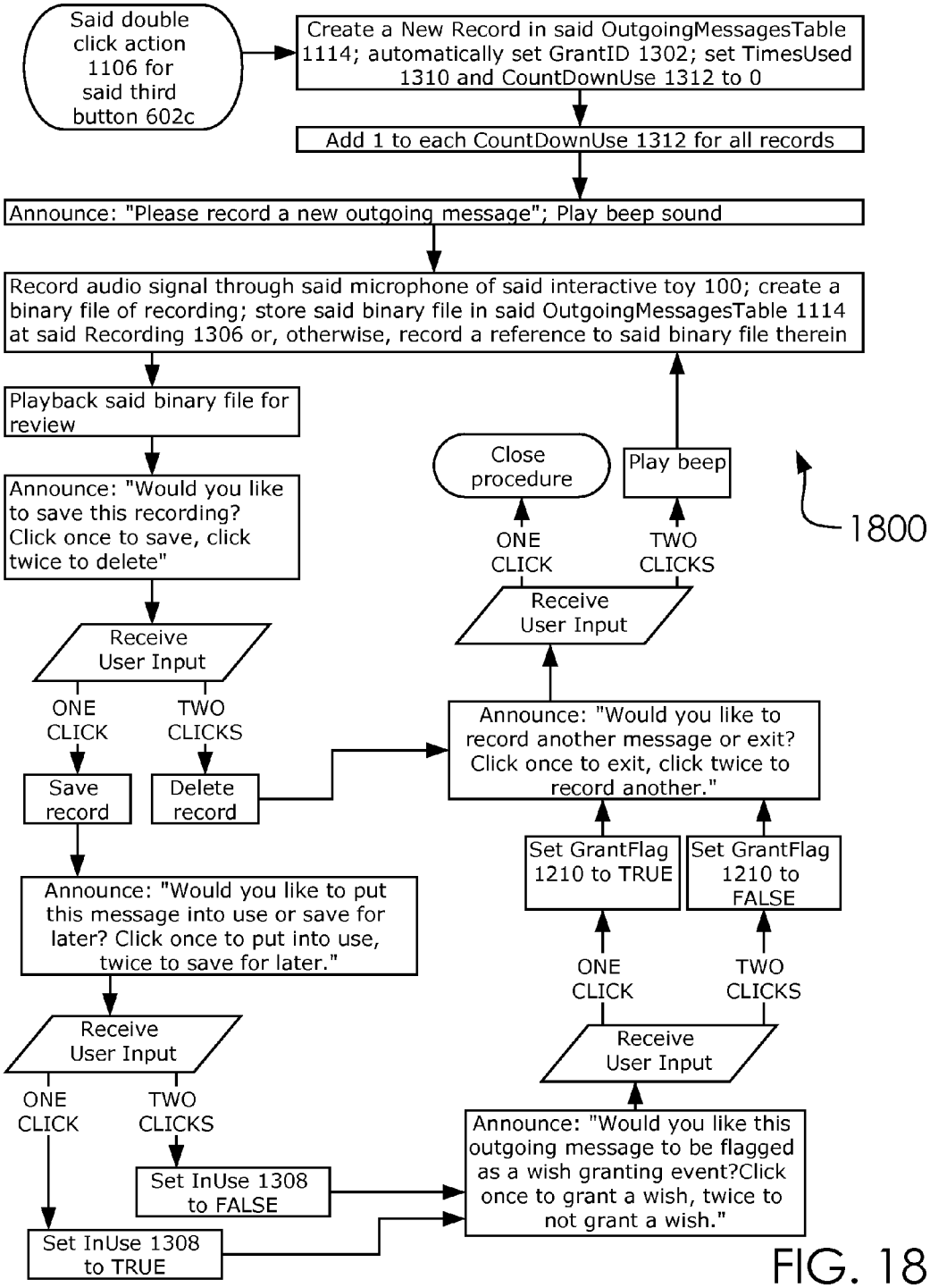
FIG. 18 illustrates a flowchart view of a record new messages dialog 1800.

FIG. 18 illustrates a flowchart view of a record new messages dialog 1800.

Said record new messages dialog 1800 can be used to insert new records into said OutgoingMessagesTable 1114, as shown and described.

Following the logic in said record new messages dialog 1800 can comprise a step by step procedure for capturing new records for said OutgoingMessagesTable 1114 using said third button 602*c*. As noted above, said third button 602*c* can be hidden inside of said upper portion 608 so as to make this procedure exclusive to a portion of said plurality of users 150 with knowledge of its existence.

Figure 19:
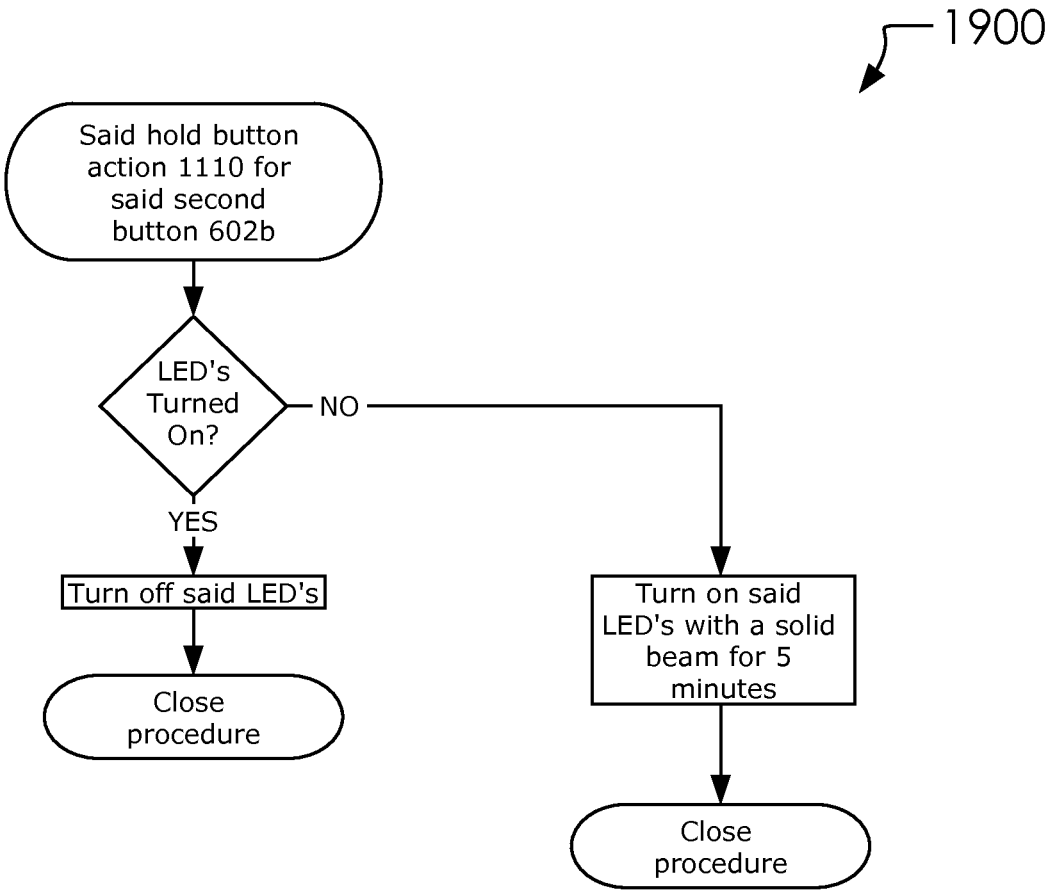
FIG. 19 illustrates a flowchart view of an activate-deactivate LEDs 1900.

FIG. 19 illustrates a flowchart view of an activate-deactivate LEDs 1900.

Said activate-deactivate LEDs 1900 can comprise a procedure for manually engaging and disengaging said first LED 614 and/or other LEDs as may be added or implied by this disclosure.

Figure 20:
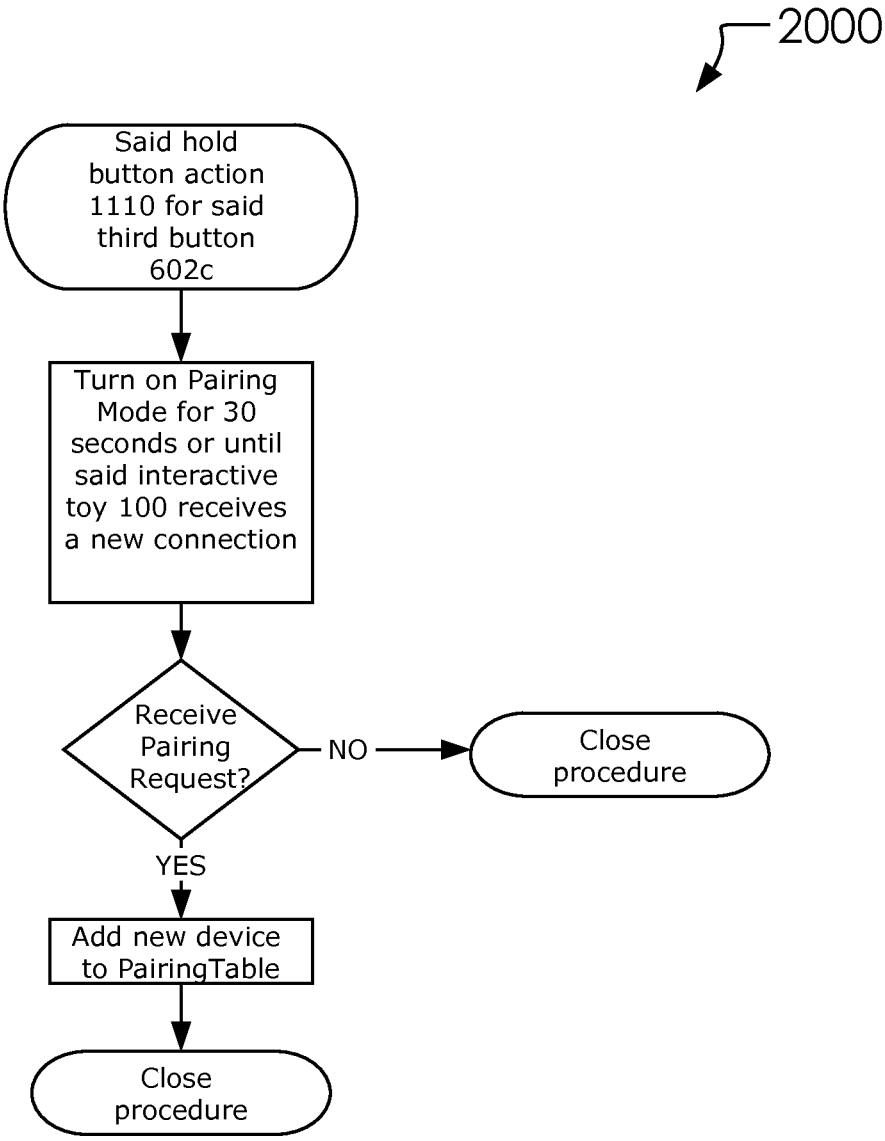
FIG. 20 illustrates a flowchart view of an activate pairing mode 2000.

FIG. 20 illustrates a flowchart view of an activate pairing mode 2000.

Said activate pairing mode 2000 can comprise a procedure for pairing devices with said interactive toy 100, as is known in the art.

Figure 21:
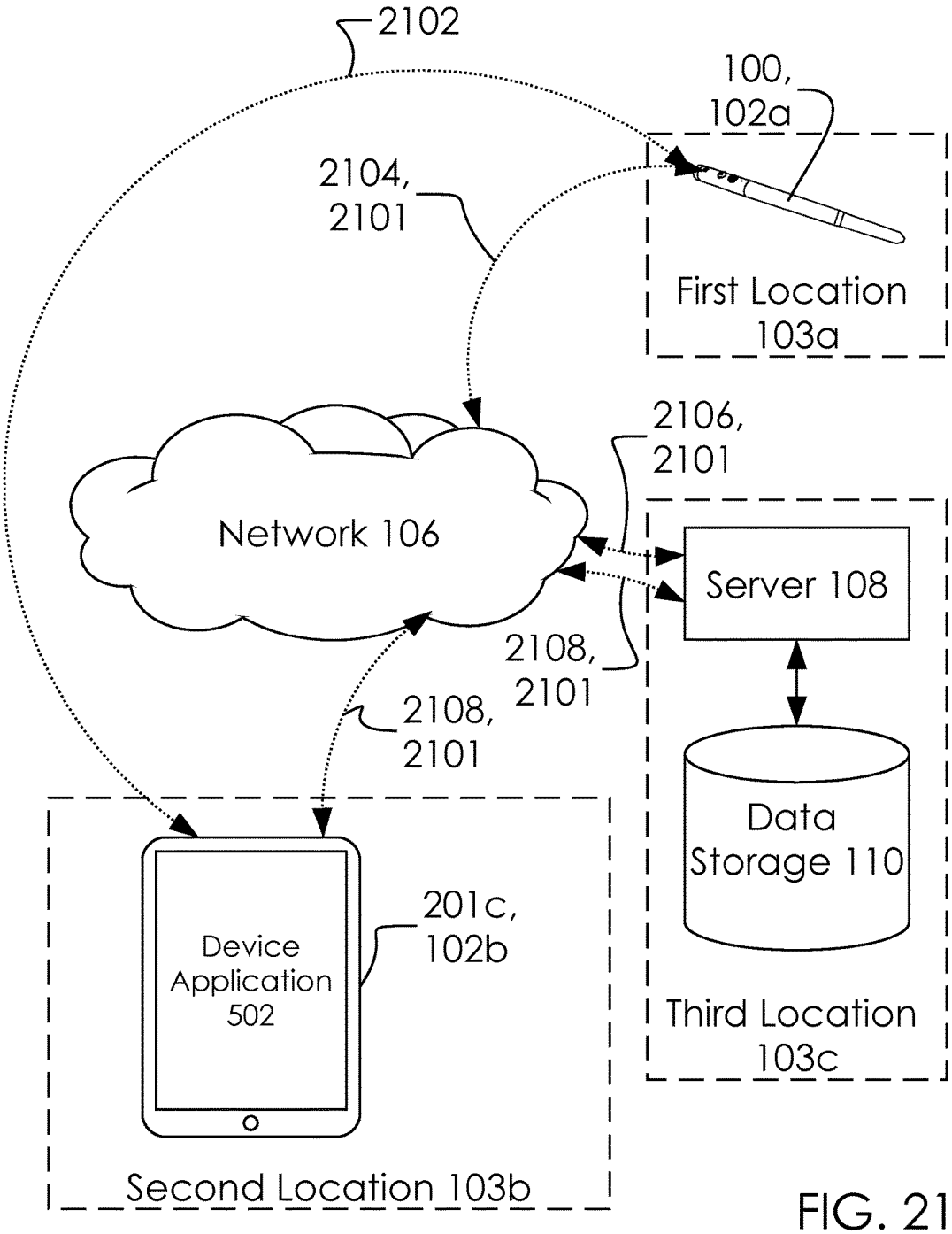
FIG. 21 illustrates a flowchart view of a first network configuration 101.

FIG. 21 illustrates a flowchart view of a first network configuration 101.

In one embodiment, said first network configuration 101 can comprise an indirect communication network 2101 comprising a device-to-network route 2104, a cloud-to-server route 2106, and a server-to-device route 2108. In another embodiment, said 1000/can communicate with said tablet 201*c* and/or another machine directly through a direct communication network 2102, as illustrated.

It should be noted as we describe these communication methods, that said interactive toy 100 need not communicate with another machine at all. As described herein, said interactive toy 100 is perfectly suited for passing back and forth between said plurality of users 150 without the presence of an exterior computer at all. This fact means that said interactive toy 100 can be built cheaply and accessible to more people without undue expense. Nonetheless, said interactive toy 100 does have the added features of being able to communicate with other machines. Those communications can move across said network 106 and/or being passed directly between machines. In both cases, it can be said that said interactive toy 100 can notify said device application 502 that a one or more new records have been added to said interactive toy 100.

In one embodiment, data collected on said interactive toy 100 can be passed to said server 108 which can in turn, format said data and pass it along to a portion of said plurality of users 150. For example, in one embodiment, said second user 150*b* can record a wish on said interactive toy 100; data associated with said wish can be passed along to said server 108 across said network 106; said server 108 can format said data associated with said wish and send it to said first user 150*a*. In practice, this means that a parent can be notified when a child has made a wish on said interactive toy 100.

In another embodiment, said interactive toy 100 can pass data directly to said second computer 102*b* in format of a notification in said device application 502, which can notify a portion of said plurality of users 150 with access to said device application 502. In one embodiment, said device application 502 can create a push notification, email, SMS, "tweet" on Twitter® or other type of notification, as is known in the art.

FIGS. 22-26 introduce and illustrate parts of said device application 502.

Said device application 502 can comprise a WishTab 2202, an OutgoingMessagesTab 2204, a PairingTab 2206, a SystemSettingsTab 2208 and a WishOffersTab 2210.

FIG. 22 illustrates a view of said device application 502 featuring said WishTab 2202.

In one embodiment, data in said device application 502 can comprise data from said data relationship diagram 1111. For example, in one embodiment, said WishTab 2202 can comprise a view of said WishTable 1112 queried with data from said OutgoingMessagesTable 1114. In one embodiment, said WishTab 2202 can summarize inputs from said second user 150*b* and can include said EventDate 1204, said WishRecording 1208, said GrantFlag 1210, said Recording 1306, and said Unread 1212.

In one embodiment, said WishTab 2202 can further comprise a share button 2214, a delete button 2216, and a view offers button 2218. In one embodiment, said selecting a one or more among said records in said WishTab 2202, and then pressing said share button 2214 can bring up a dialog for sharing through means well-known in the art such as social networks, email and similar. Likewise, in one embodiment, selecting a one or more among said records in said WishTab 2202 and then pressing said delete button 2216 can cause those records being selected to be deleted. In one embodiment, a message can confirm the delete procedure before conducting the same. Finally, said view offers button 2218 can activate a process of parsing said Transcription 1216 and activating a vendor search procedure 3000, as described below. In one embodiment, said vendor search procedure 3000 can populate said VendorOffersTable 1122, which can be displayed on said WishOffersTab 2210, as described below.

Figure 23:
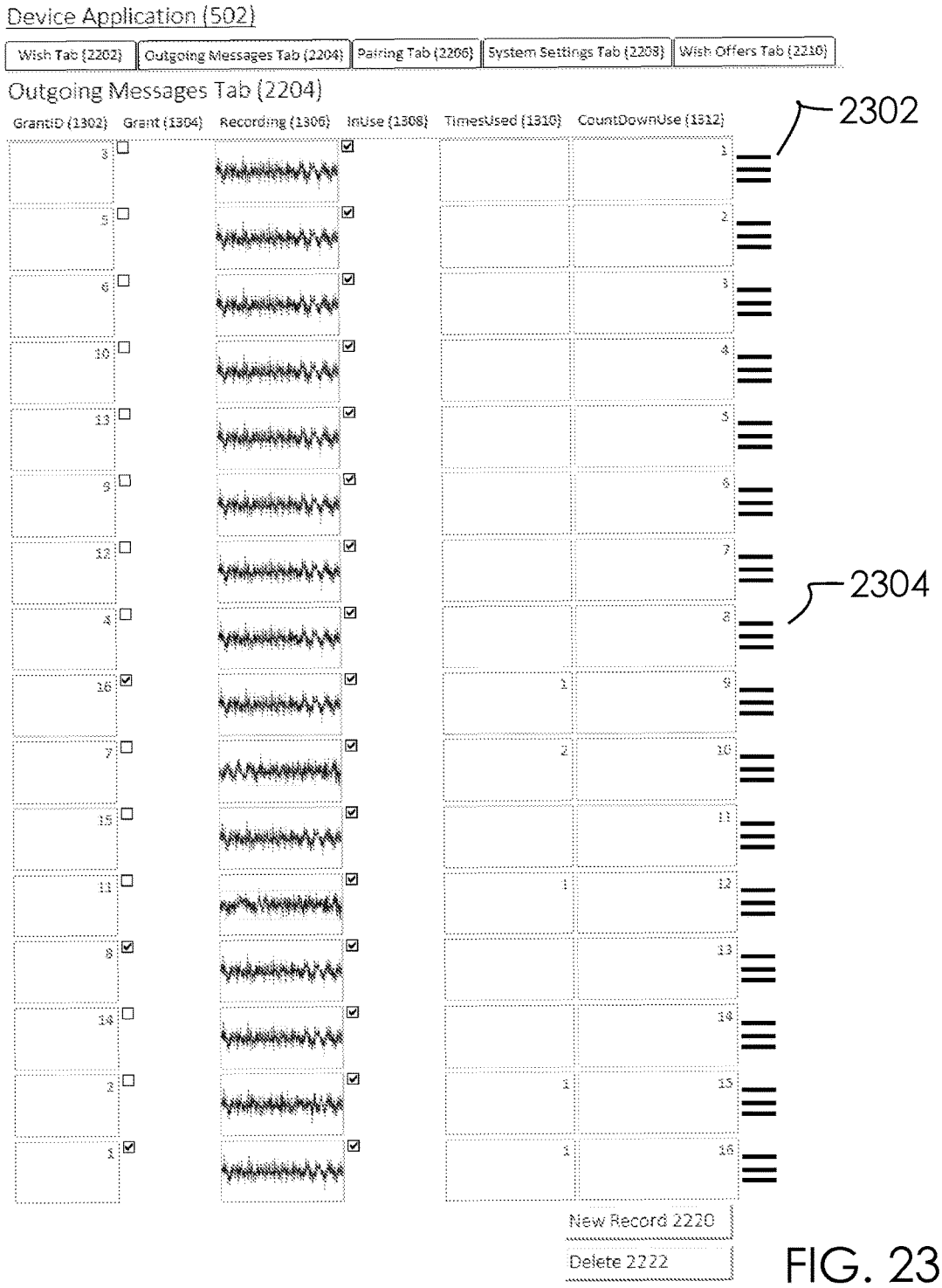

FIG. 23 illustrates a view of said device application 502 featuring said OutgoingMessagesTab 2204.

In one embodiment, said WishTab 2202 can be sorted according to which among the records in said button description 1102 shall be played back next by sorting said CountDownUse 1312 from smallest to largest. In one embodiment, a user of said device application 502 can resort records in said WishTab 2202 by dragging records up and down according to the conventions of sorting commonly used systems. In one embodiment, said reordering field can be played back by clicking on the relevant image or field.

In one embodiment, said OutgoingMessagesTab 2204 can summarize events from said wish granting procedure 1400. In one embodiment, places where said Recording 1306 is filled and said Grant 1304 is TRUE, a user has left a voice message for review by another user of said interactive toy 100. In one embodiment, said OutgoingMessagesTab 2204 can be sorted by reverse chronological order by either sorting by said EventDate or said EventID in descending order.

In one embodiment, said OutgoingMessagesTab 2204 can comprise a new record button 2220 and a delete record button 2222. In one embodiment, these buttons will function as expected in the art.

In one embodiment, users can collect information using said interactive toy 100. For example, in one embodiment, said Recording 1306 can comprise: (i) a question as to a user preference, (ii) a psychological self-assessment, (iii) a request for an honest opinion, (iv) a light hearted question, and/or (v) a wish to be granted.

In one embodiment, said OutgoingMessagesTab 2204 can comprise an ungrantable outgoing message 2302 and a grantable outgoing message 2304. In one embodiment, where one among said ungrantable outgoing message 2302 has been selected, the outgoing message can be something like "I cannot grant you a wish right now, but I do have a joke . . . " so as to console the user (such as said second user 150*b*) when not receiving a granted wish. Alternatively, where said grantable outgoing message 2304 is outgoing, a message like the following may be played through said speaker 1002, "Good news, you've been granted a wish. While you keep your finger on the wish button, tell me what makes you happiest of all".

FIG. 24 illustrates a view of said device application 502 featuring said PairingTab 2206.

In one embodiment, said PairingTab 2206 can summarize all devices having been paired with said interactive toy 100.

FIG. 25 illustrates a view of said device application 502 featuring said SystemSettingsTab 2208.

In one embodiment, said SystemSettingsTab 2208 can update as settings of said interactive toy 100 change. In one embodiment, the current settings of said interactive toy 100 can comprise the record having the most recent date in said DateChanged 1242 field or, else, the highest ID field where records are assigned ascending numbers as records are added.

FIG. 26 illustrates a view of said device application 502 featuring said WishOffersTab 2210.

In one embodiment, said WishOffersTab 2210 can illustrate a connection between said WishTable 1112 and said VendorOffersTable 1122.

In one embodiment, said VendorOffersTable 1122 can be populated through said vendor search procedure 3000, as discussed further below.

In one embodiment, portions of said VendorOffersTable 1122 are included on said WishOffersTab 2210 as an offers sub-query 2604. In one embodiment, said offers sub-query 2604 can hold records related to said Transcription 1216 and offer prices or coupons in said 1330, as illustrated. Further, said plurality of users 150 can select one among the records in said offers sub-query 2604 and the click an order item button 2602 to accept the offer. In one embodiment, said device application 502 can store account information for a portion of said plurality of users 150 which will facilitate quick ordering and delivery of wishes.

In one embodiment, said second user 150*b* can wish for a new bike, said second user 150*b* can receive the notification, click on said WishOffersTab 2210, the select one among said offers sub-query 2604, and finally, fulfill the wishes of said first user 150*a*.

Figure 27:
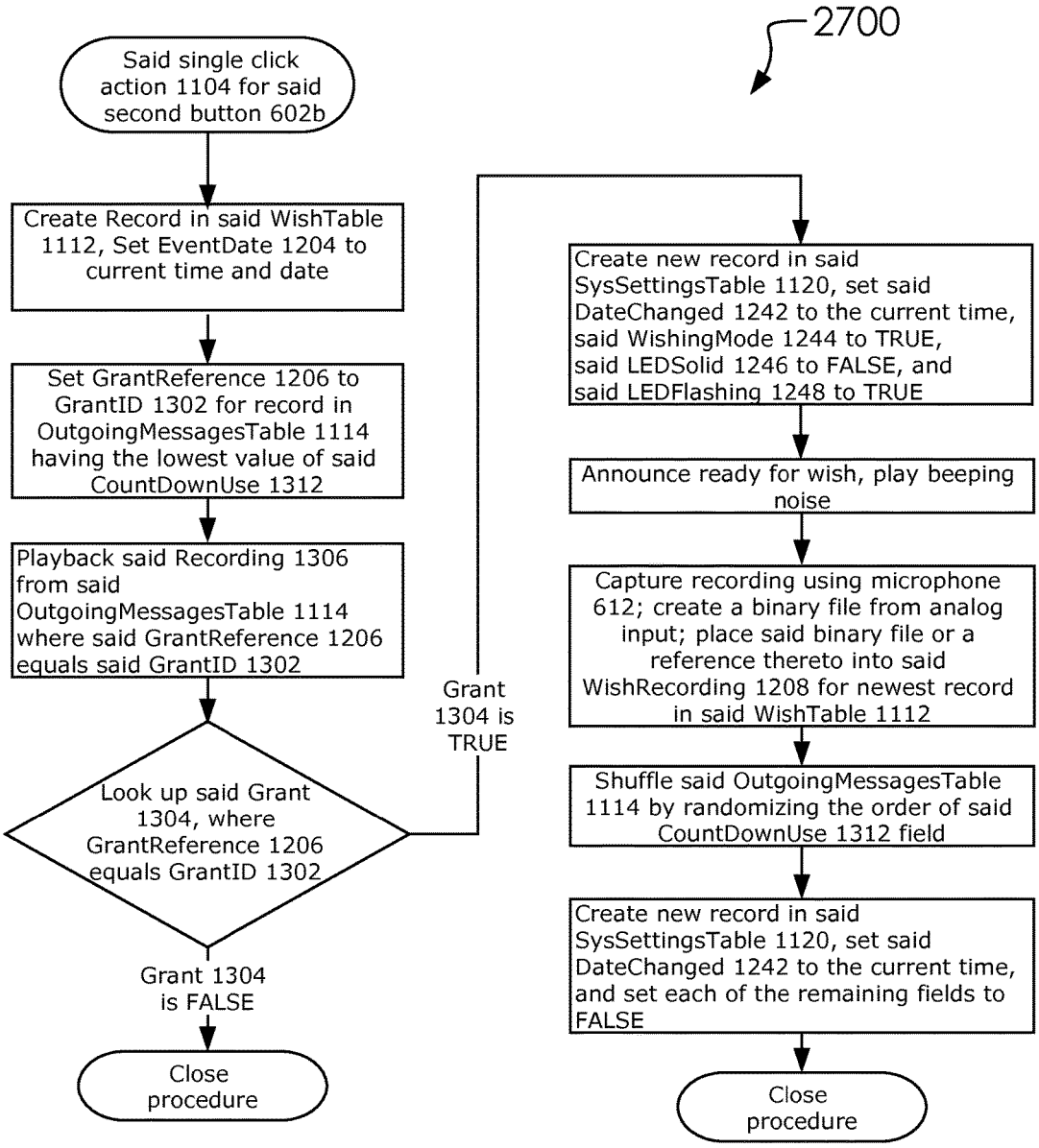
FIG. 27 illustrates a flowchart view of a simplified wish granting procedure 2700.

FIG. 27 illustrates a flowchart view of a simplified wish granting procedure 2700.

In one embodiment, said simplified wish granting procedure 2700 can comprise portions of said wish granting procedure 1400, but more simplified. In one embodiment, said simplified wish granting procedure 2700 might be used where said interactive toy 100 is not attached to said network 106 and therefore acts independently.

Figure 28:
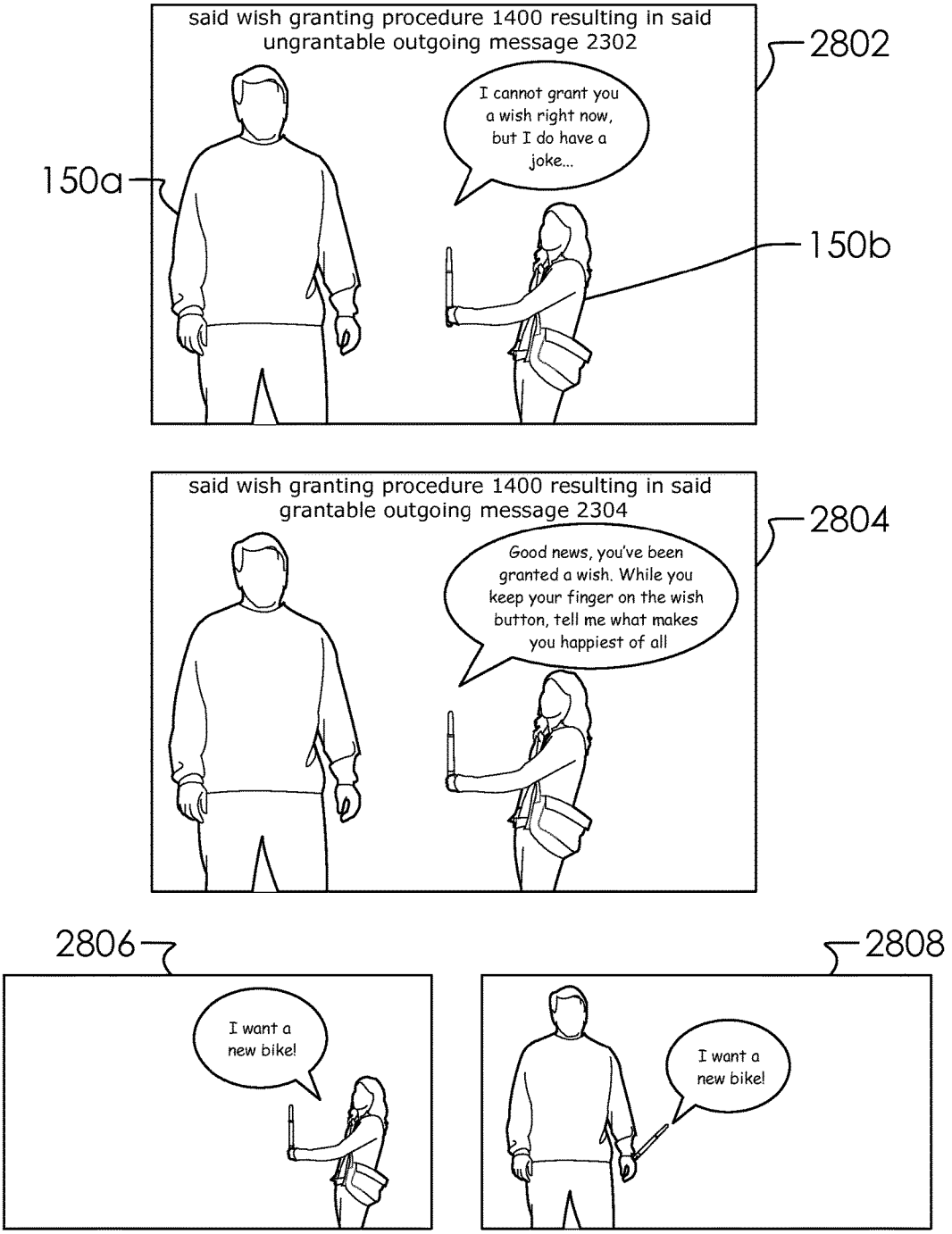
FIG. 28 illustrates a dialog illustration 2800 between said plurality of users 150 and said interactive toy 100.

FIG. 28 illustrates a dialog illustration 2800 between said plurality of users 150 and said interactive toy 100.

In one embodiment, dialog illustration 2800 can comprise a first frame 2802, a second frame 2804, a third frame 2806, and a fourth frame 2808.

Figure 29A:
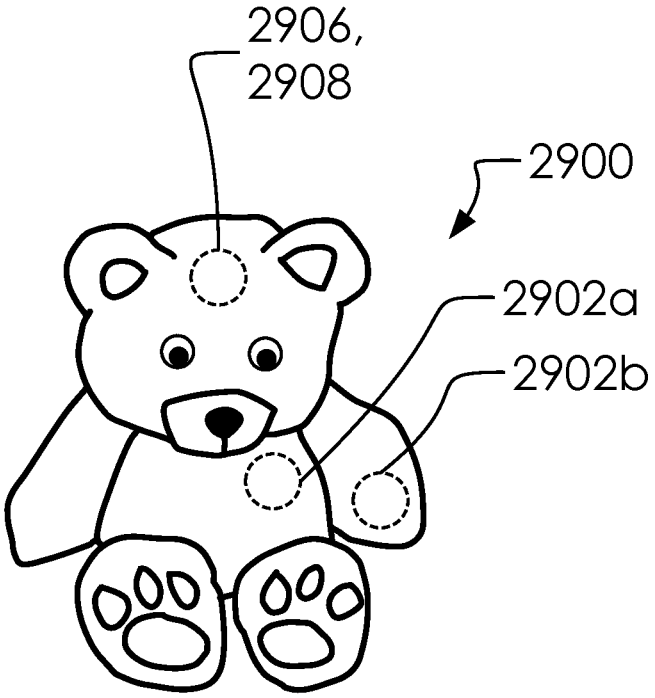
FIGS. 29A and 29*b* illustrate an elevated front and rear view of an alternative interactive toy 2900.
Figure 29B:
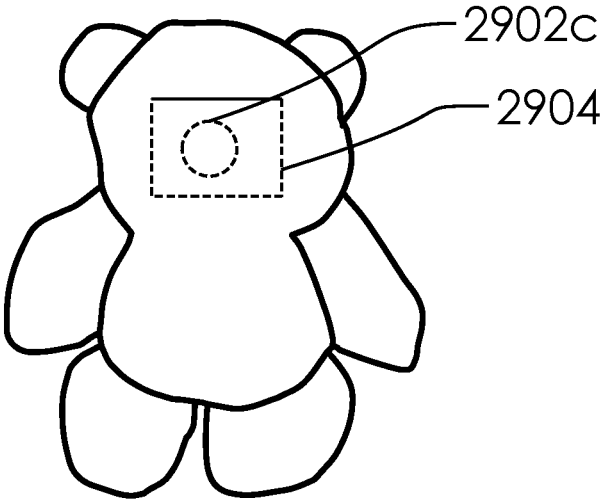

FIGS. 29A and 29*b* illustrate an elevated front and rear view of an alternative interactive toy 2900.

In one embodiment, said interactive toy 100 can be packaged up into other form factors with similar functionality. For example, in one embodiment, said interactive toy 100 can be packaged into said alternative interactive toy 2900.

In one embodiment, said alternative interactive toy 2900 can comprise a one or more buttons 2902 which can comprise a first button 2902*a*, and a second button 2902*b*. In one embodiment, said alternative interactive toy 2900 can comprise a flap 2904 which can selectively cover said third button 2902*c*. In one embodiment, said one or more buttons 2902 can comprise corresponding functionality to said one or more buttons 602. Likewise, in one embodiment, said alternative interactive toy 2900 can comprise a speaker 2906 and a microphone 2908. In one embodiment, portions of said alternative interactive toy 2900 can be hidden below a surface layer, as is known in the art. In one embodiment, said one or more buttons 2902 can be pressed by squeezing an exterior portion of said alternative interactive toy 2900, as is known in the art. Accordingly, the functionality of said interactive toy 100 can be wrapped into different form factors, such as said alternative interactive toy 2900.

To this end, it is hereby disclosed that the functionality of said interactive toy 100 can be accomplished virtually on an app on a smart phone or computer. The Applicant by this disclosure claims the benefit of such an understanding of his system.

Figure 30:
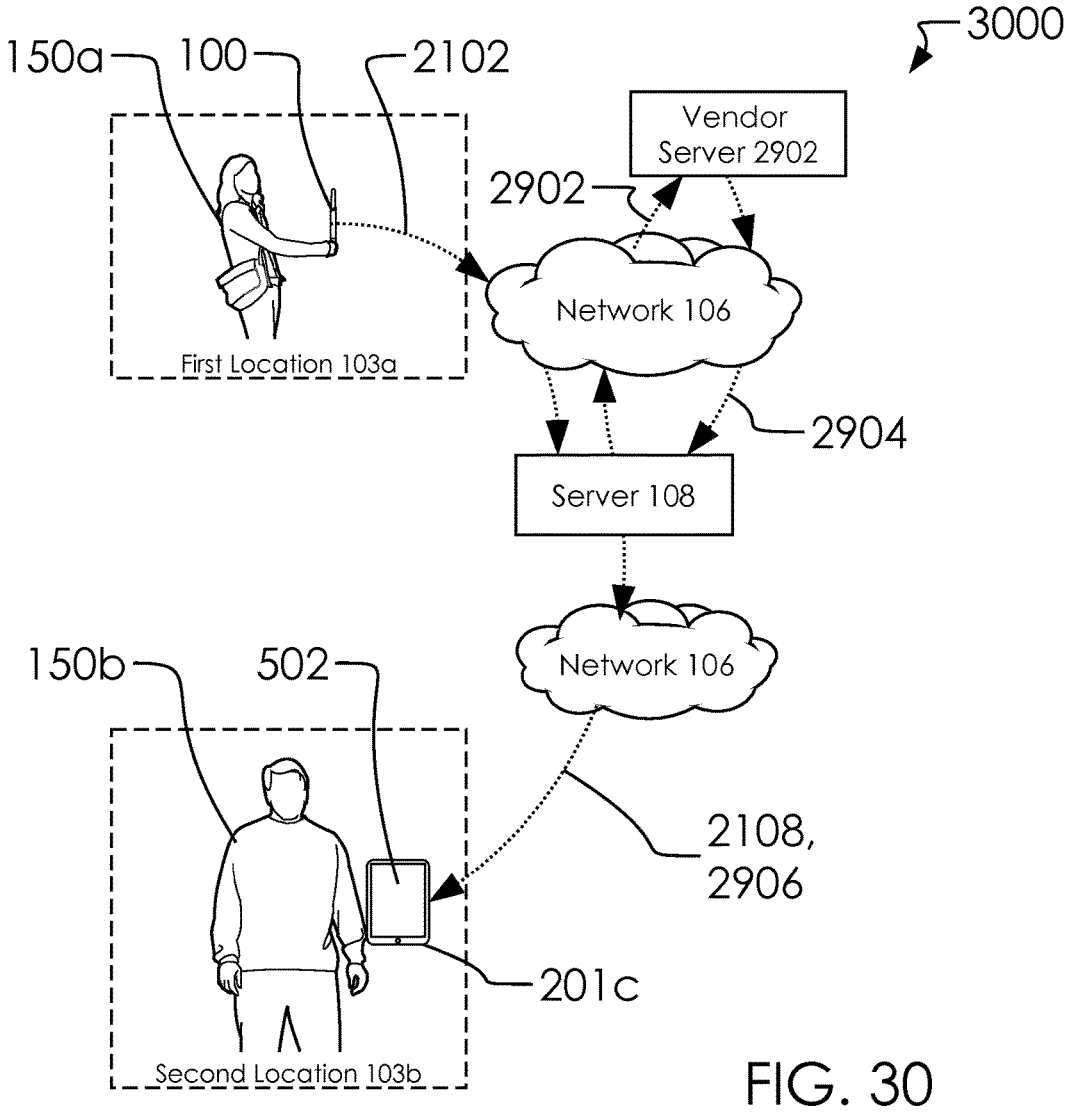
FIG. 30 illustrates a vendor search procedure 3000.

FIG. 30 illustrates a vendor search procedure 3000.

In one embodiment, said interactive toy 100 can use said vendor search procedure 3000 to retrieve valuable information from a one or more merchants or vendors on behalf of said plurality of users 150 and for the generation of fees for such connections.

In one embodiment, said vendor search procedure 3000 can comprise passing portions of said OutgoingMessagesTable 1114 to said server 108, especially said Transcription 1216 record representing a distillation of the wishes of one or more of said plurality of users 150. In one embodiment, said server 108 can be configured to search a one or more vendor servers 3002 for similar items, offers for purchase and for fees such as said AppProfit 1332. In one embodiment, said one or more vendor servers 3002 can send back data to be stored in said VendorOffersTable 1122. A portion of said VendorOffersTable 1122 can be displayed for said second user 150*b* on said device application 502, as show in said WishOffersTab 2210, above. In one embodiment, said network 106 can be used for portion of this transmission. In another embodiment, said device application 502 can fetch records from said one or more vendor servers 3002 directly without using said server 108 at all.

In one embodiment, said interactive toy 100 can communicate with said server 108 through said direct communication network 2102. In one embodiment, said server 108 can communicate with said one or more vendor servers 3002 through a server-to-vendor connection 3002 and data can be returned to said server through a vendor-to-server connection 3004. In one embodiment, said server 108 can communicate with said device application 502 through said server-to-device route 2108, which in this case can also be called a server-to-device route 3006.

Figure 31:
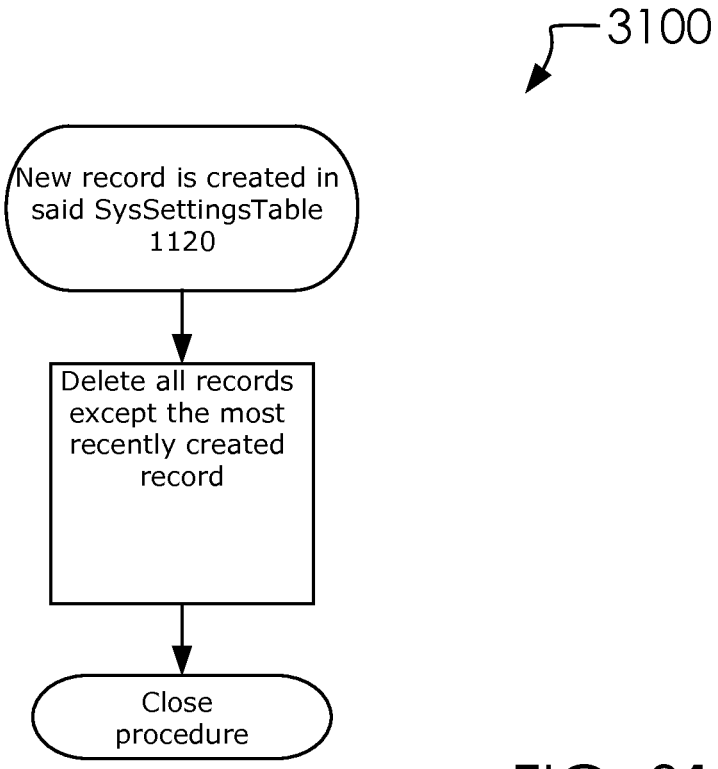
FIG. 31 illustrates a cleanup procedure 3100 for said SysSettingsTable 1120.

FIG. 31 illustrates a cleanup procedure 3100 for said SysSettingsTable 1120.

Figure 32:
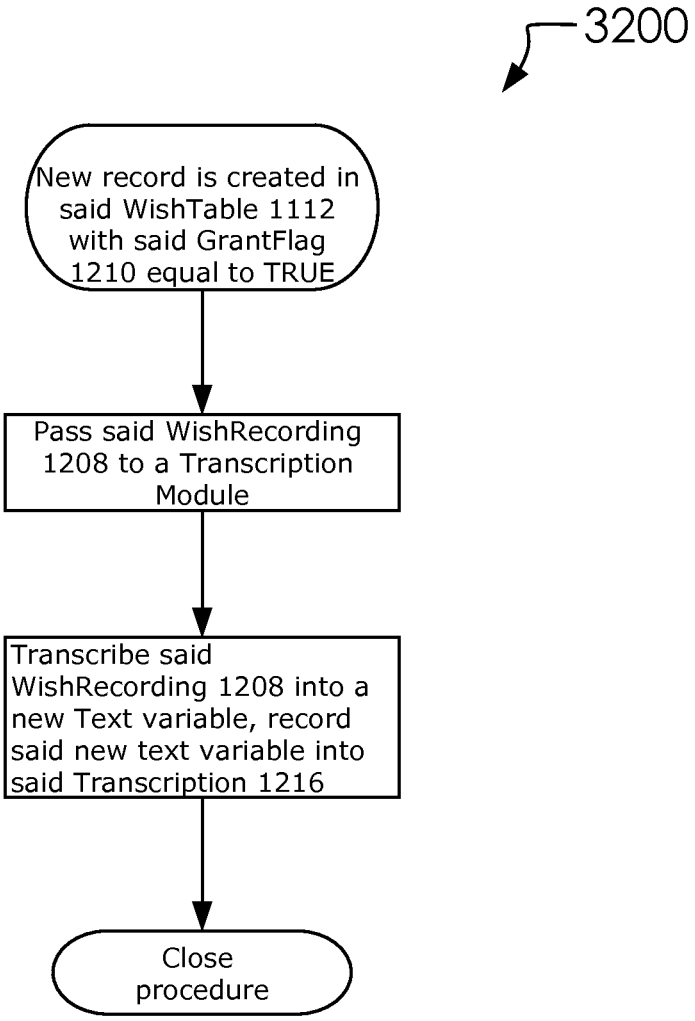
FIG. 32 illustrates a transcription procedure 3200.

FIG. 32 illustrates a transcription procedure 3200.

In one embodiment, said transcription procedure 3200 can pass portions of said WishRecording 1208 to a transcription module, meaning a portion of a software system configured to take spoken word content and generate text from that content. In the art, this is sometimes called text-to-speech. Examples of this technology can be found in Apple® Siri®, Google® Now, and/or Dragon Dictate®. At the time of this disclosure, such systems are common place and often made available to developers as a part of the standard SDK when developing software. Note that in some cases audio files are sent to remote server and text is returned to the development environment. One example of this approach is that of Google® Now. The functionality of said transcription procedure 3200 will be operational without to regard to the location of the transcription provided said network 106 is available where necessary.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. An interactive toy system comprising:

an outer body, two or more buttons, an integrated circuit, a battery, a speaker, and a microphone;

said two or more buttons, said battery, said speaker and said microphone are wired into said integrated circuit;

said integrated circuit comprising one or more processors, and a memory;

said memory of said integrated circuit configured to store a plurality of outgoing messages comprising a first portion and a second portion, one or more incoming messages, and one or more settings comprising at least a wishing mode flag;

said first portion of said plurality of outgoing messages comprises a grant flag set to true;

said second portion of said plurality of outgoing messages comprises said grant flag set to false;

said two or more buttons comprises a first button and a second button;

said first button is accessible outside of said outer body;

said second button is enclosed within said outer body;

said two or more buttons are configured to receive one or more user inputs comprising at least a first input triggered with said first button and a second input triggered with said second button;

said first portion of said plurality of outgoing messages comprise a one or more outgoing messages;

when said first input is received said processor determines whether said wishing mode flag is set to true and if so then, said processor initiates one among said first portion of said plurality of outgoing messages, said microphone is activated to capture a new incoming message to be added to said one or more incoming messages and said new incoming message is associated with an incoming message grant flag being set to true by said processor;

said interactive toy system is configured for use with a first user group and a second user group;

said second user group comprises one or more children;

said first user group comprises a parent, guardian, or role model to said second user group said second input is concealed from said second user group; and when said second input is received, said processor is configured to edit said plurality of outgoing messages, set said wish mode flag to true or false, and review and edit a portion of said one or more incoming messages.

2. The interactive toy system of claim 1 wherein:

said interactive toy system is configured to deliver said one or more incoming messages of said first user group to said second user group.

3. The interactive toy system of claim 1 wherein:

said integrated circuit comprises said one or more processors, said memory, and a communication hardware;

said interactive toy system selectively communicates with one or more computers on a network with said communication hardware; and said interactive toy system is configured to selectively transmit and receive a transmitted portion of said plurality of outgoing messages and a transmitted portion of said one or more incoming messages.

4. The interactive toy system of claim 1 wherein:

said outer body contains a portion of said battery, said integrated circuit, and said speaker.

5. The interactive toy system of claim 1 wherein:

said first button is used for recording said one or more incoming messages;

said second button is for recording said plurality of outgoing messages; and said first input comprises pressing said first button at least one time.

6. The interactive toy system of claim 5 wherein:

said second button is selectively enclosed within said outer body of said interactive toy system to be substantially inaccessible to a second user group and readily accessible to a first user group.

7. The interactive toy system of claim 1 wherein:

said integrated circuit comprises a system on a chip comprising said one or more processors, said memory and a communication hardware on one chip; and said integrated circuit is powered by said battery.

8. The interactive toy system of claim 1 wherein:

said interactive toy system further comprises one or more LEDs comprising a first LED;

said first LED is in data and power communication with said integrated circuit; and said integrated circuit controls a frequency, an intensity and a status of said first LED.

9. The interactive toy system of claim 1 wherein:

said outer body comprises the shape of a magician's wand;

said outer body comprises a tip portion, an upper portion and an end cap;

said outer body comprises a first diameter at a first end and a second diameter at a second end;

said tip portion selectively attaches to said upper portion at said first end of said outer body;

said end cap selectively attaches to said upper portion at said second end of said outer body;

said first diameter is smaller than said second diameter; and said outer body comprises a conical shape.

10. The interactive toy system of claim 1 wherein:

said outer body comprises an upper portion and an end cap;

said end cap selectively attaches to said upper portion at a second end of said outer body;

with said end cap removed, said integrated circuit and said battery can be accessed within said outer body; and said a portion of said two or more buttons are accessible outside of said outer body.

11. The interactive toy system of claim 1 wherein:

said outer body comprises an upper portion and an end cap;

said end cap selectively attaches to said upper portion at a second end of said outer body; and said two or more buttons are wired into said integrated circuit.

12. The interactive toy system of claim 1 wherein:

a device application embodied on a second computer comprising a non-transitory computer readable storage medium and one or more processors; and said device application being encoded with instructions to control said one or more processors to perform a process of playing said plurality of outgoing messages from a first user group where each is associated with said grant flag, recording one or more incoming messages from a second user group when said grant flag is set to true, and transmitting a portion of said one or more incoming and said plurality of outgoing messages to said first user group.

13. The interactive toy system of claim 1 wherein:

said integrated circuit comprises said one or more processors, said memory, and a communication hardware;

said interactive toy system selectively communicates with one or more computers on a network with said communication hardware;

said one or more computers configured to operate a device application; and said interactive toy system is configured to selectively transmit and receive a transmitted portion of said plurality of outgoing messages and a transmitted portion of said one or more incoming messages with said device application on said one or more computers.

14. The interactive toy system of claim 1 wherein:

a server, a network and a device application;

said interactive toy system configured to communicate with said server across said network;

said interactive toy system configured to record said one or more incoming messages to a WishTable in a database, and transmit a portion of said WishTable to said server; and said server is configured to notify said device application when new records are added to said WishTable.

15. The interactive toy system of claim 14 wherein:

one or more vendor servers in communication with said server over said network;

said server is configured to transcribe said one or more incoming messages in said WishTable and record such transcriptions as a transcription field in said WishTable;

said server transmits a portion of said transcription field to said one or more vendor servers;

said one or more vendor servers thereafter provide offers for items related to said transcription field including a description field and a price offer field, which are returned to said server and stored in a VendorOffersTable; and said device application is configured to receive a portion of said one or more incoming messages along with a portion of said VendorOffersTable.

16. The interactive toy system of claim 15 wherein:

said one or more vendor servers also provide an AppProfit field comprising a portion of said price offer field which is to be paid to an operator of said server as an incentive for presenting said description field and said price offer field to users in possession of said device application.

* * * * *